US005553035A

United States Patent [19]

Seyed-Bolorforosh et al.

[11] Patent Number: 5,553,035

[45] **Date of Patent: *Sep. 3, 1996**

[54] METHOD OF FORMING INTEGRAL TRANSDUCER AND IMPEDANCE MATCHING LAYERS

[75] Inventors: Mir S. Seyed-Bolorforosh, Palo Alto; Hewlett E. Melton, Sunnyvale, both of Calif.; Martha G. Wilson, Andover, Mass.

[73] Assignee: Hewlett-Packard Company, Palo Alto, Calif.

[ * ] Notice: The term of this patent shall not extend beyond the expiration date of Pat. No. 5,434,827.

[21] Appl. No.: 327,167

[22] Filed: Oct. 21, 1994

Related U.S. Application Data

[63] Continuation-in-part of Ser. No. 77,188, Jun. 15, 1993, Pat. No. 5,371,717, and a continuation-in-part of Ser. No. 77,530, Jun. 15, 1993, Pat. No. 5,434,827, and a continuation-in-part of Ser. No. 77,179, Jun. 15, 1993, Pat. No. 5,392,259.

[51] Int. Cl.[6] ..... H04R 17/00

[52] U.S. Cl. ..... 367/140; 367/152; 367/155; 367/157; 310/320; 128/662.03

[58] Field of Search ..... 367/140, 152, 367/155, 157; 310/320; 128/662.03

[56] References Cited

U.S. PATENT DOCUMENTS

| | | | |
|---|---|---|---|
| 4,939,826 | 7/1990 | Shoup | 29/25.35 |
| 5,434,827 | 7/1995 | Bolorforosh | 367/140 |

OTHER PUBLICATIONS

Newnham, R. E., et al., "Connectivity and Piezoelectric–Pyroelectric Composites," *Materials Research Bulletin,* vol. 13, 1978, pp. 525–536, Pergamon Press, Inc.

Oakley, Clyde, et al., "Development of 1–3 ceramic–air composite transducers," *SPIE,* vol. 1733, 1992, pp. 274–283.

Smith, Wallace Arden, "New opportunities in ultrasonic transducers emerging from innovations in piezoelectric materials," *SPIE,* vol. 1733, 1992, pp. 3–26.

Smith, Wallace Arden, "Modeling 1–3 Composite Piezoelectrics: Thickness–Mode Oscillations," *IEEE Transactions on Ultrasonics, Ferroelectrics, and Frequency Control,* vol. 38, No. 1, Jan. 1991, pp. 40–47.

*Primary Examiner*—J. Woodrow Eldred

[57] ABSTRACT

A method of forming a transducer device having integral transducer and impedance matching portions includes forming grooves partially through a thickness of a piezoelectric member. A groove volume fraction at the impedance matching portion controls the electrical impedance. The impedance matching portion may be at either or both of the front and rear surfaces of the transducer portion, which generates acoustic wave energy in response to application of a drive signal. The drive signal is introduced by electrodes. In one embodiment, the electrode at the impedance matching portion extends into the grooves, but preferably a filler material is selected and deposited to allow use of a planar electrode. An alternative embodiment to fabricating the transducer device is to assemble piezoelectric material. For example, an integral transducer and impedance matching portions may be formed by using molding techniques or by stacking dimensionally different thin piezoelectric layers. The acoustic impedance of the matching layer can be varied spatially to provide apodization of a radiating aperture. Moreover, a graded impedance matching layer can be formed, resulting in a tapered variation in the acoustic impedance of the matching layer.

21 Claims, 16 Drawing Sheets

METHOD OF FORMING INTEGRAL TRANSDUCER AND IMPEDANCE MATCHING LAYERS

CROSS REFERENCE TO RELATED APPLICATIONS

This application is a continuation-in-part of patent application Ser. Nos. 08/077,188, 08/077,530 and 08/077,179, each filed Jun. 15, 1993 now U.S. Pat. Nos. 5,371,717, 5,434,827, and 5,392,259, respectively.

TECHNICAL FIELD

The present invention relates generally to ultrasonic transducer devices and more particularly to methods of fabricating transducer devices having integrated acoustic impedance matching layers.

BACKGROUND ART

A diagnostic ultrasonic imaging system for medical use may be utilized to form images of tissues of a human body by electrically exciting a piezoelectric transducer element or an array of elements, which then generates short acoustic pulses, conventionally within the ultrasonic frequency region, that are caused to travel into the body. Echoes from tissues are received by the ultrasonic transducer element or elements and are converted into electrical signals. Electrical signals are amplified and used to form a cross sectional image of the tissues. Echographic examination is also employed outside of the medical field.

An ultrasonic transducer probe is used to generate a beam of broadband acoustic waves that is acoustically coupled from a front portion of the probe, through an acoustic lens, and into a medium of interest, such as a human body. The acoustic lens is used to focus the beam of acoustic waves. Within the medium of interest, various structures will reflect a degree of the beam of acoustic energy. Weak reflections are received at the front portion of the ultrasonic probe. By analyzing the relative delay and intensity of weakly received acoustic energy, an imaging system may be used to extrapolate an image of the structures within the body.

Since the acoustic wave energy that enters the medium of interest is only weakly reflected back to the ultrasonic probe by the structures within the medium, it is important to reduce any acoustic wave energy reflected by a rear portion of the probe. If a portion of the acoustic waves that are generated by the probe is directed rearwardly and is reflected by the rear portion of the probe, a first unwanted acoustic signal will be transmitted into the medium of interest. Similarly, if a portion of the weakly reflected wave energy that is received by the probe is transmitted through the probe and then reflected by the rear portion, a second unwanted acoustic signal is produced. As a result, distortions will occur within the extrapolated image.

An approach to reducing reflections from the rear portion of the probe is to attach an acoustically damping support body to the rear face of the probe. The damping support body is typically referred to as the backing layer. In order to further reduce reflections, a layer of matching material may be coupled between the piezoelectric layer and the damping support body. For example, an ultrasonic transducer may include a piezoelectric layer of lead zirconate titanate (PZT) having an acoustic impedance of $33\times10^6$ kg/m$^2$s, a dissimilar acoustic layer of silicon having an acoustic impedance of $19.5\times10^6$ kg/m$^2$s, and a damping support body of epoxy resin having an acoustic impedance of $3\times10^6$ kg/m$^2$s. The silicon layer is used to provide an improved acoustic impedance match between the relatively high acoustic impedance of the PZT layer and the relatively low acoustic impedance of the epoxy resin support body. Typically, the impedance matching layer has a thickness that is one-quarter wavelength of the resonant frequency of the transducer.

While the use of a back matching layer and an acoustically damping support body reduces the reflections at the rear of the device, reflections nevertheless occur, since a degree of impedance mismatch still exists. Furthermore, a thin layer of adhesive is applied to bond each of the layers, thereby creating undesirable adhesive bond lines. The thickness of the bond line may vary within a range of 2 microns to 25 microns, thus becoming an additional source of acoustic wave energy reflection. Another concern is that the bonding process steps sometimes create manufacturing difficulties. For example, during manufacturing it is difficult to ensure that no voids are introduced into the adhesive. Such voids impair operation of the probe. Furthermore, reliability of ultrasonic transducers is adversely affected by differing thermal expansion coefficients of the layers. Over time, some of the adhesive bonds may lose integrity, resulting in transducer elements that no longer provide efficient acoustic coupling. Yet other concerns are that the bond lines may impose limits on operational performance of the probe at high acoustic signal frequencies, such as frequencies above 20 MHz, and that the availability of suitable materials having the desired acoustic properties for the required impedance matching layer might be limited.

Acoustic impedance matching is also important at the front portion of the ultrasonic device. Efficient acoustic coupling to the medium of interest reduces the reflection at the interface of the acoustic device and the medium. Minimizing reflection is important both in transmitting wave energy from the device to the medium and in receiving the energy from the medium for imaging tissue structures and the like. As previously noted, a PZT transducer layer has an acoustic impedance of approximately $33\times10^6$ kg/m$^2$s. The acoustic impedance of PZT is poorly matched with the acoustic impedance of human tissue, which has a value of approximately $1.5\times10^6$ kg/m$^2$s.

One technique for reducing energy reflection at the front portion of the device is to utilize a front impedance matching layer having a thickness of one-quarter of the wavelength of the operating frequency of the transducer and having an acoustic impedance equal to the square root of the product of the acoustic impedances of the device and the medium. The front matching layer is bonded to the piezoelectric material in the same manner as the back matching layer. Thus, the same concerns exist at the front surface, e.g. the selected bonding material may create a layer that tends to interfere with the acoustic wave transmission, especially at relatively high ultrasonic frequencies, and there are reliability issues, such as adhesive debonding.

Another approach to improve acoustic coupling is described in "New Opportunities in Ultrasonic Transducers Emerging from Innovations in Piezoelectric Materials," W. A. Smith, SPIE (Society of Photo-Optical Instrumentation Engineers), Volume 1733 (1992), pages 3–26 and in "Modeling 1–3 Composite Piezoelectrics: Thickness-Mode Oscillations," W. A. Smith, *IEEE Transactions on Ultrasonics, Ferroelectrics and Frequency Control*, Volume 38, No. 1, (January 1991). Smith describes forming a piezocomposite wave-generating layer that is a combination of piezoelectric ceramic and a passive polymer. In what is described as the most widely used method to make the 1–3 piezocomposites, a block of piezoceramic material is subjected to a dice-and-fill technique in which two sets of cuts are formed at right angles to each other. A polymer is then cast into the cuts. After polishing the resulting structure to the desired thickness, electrodes are applied to the opposed surfaces and the ceramic is poled to align ferromagnetic domains. The resulting structure is one in which the wave-generating layer has an array of full-thickness piezoceramic pillars that are spaced apart by the polymer. Consequently, the structure has an acoustic impedance that is lower than the acoustic impedance of bulk piezoceramic, reducing the acoustic impedance mismatch with the medium of interest.

While composite materials provide some improved acoustic coupling to various media, there are difficulties in electrically sensing reflected acoustic waves received by such composites. The dielectric constant is relatively small. For example, for a composite that is 50% polymer and 50% piezoelectric ceramic, the dielectric constant measurable between electrodes of the high polymer is approximately half of that which is inherent to the piezoelectric ceramic. A much higher dielectric constant is desirable, so that a higher capacitive charging is sensed by the electrodes in response to received acoustic waves. A higher dielectric constant also provides an improved electrical impedance match between the ultrasonic device and components of the imaging system that are electrically coupled to the device.

What is needed is a method of fabricating a transducer device that provides enhanced operational performance.

SUMMARY OF THE INVENTION

A method of fabricating a transducer device includes forming an acoustic impedance matching portion that extends in a unitary fashion from a transducer portion. That is, the portion of the device that is used in converting between electrical and acoustic wave energy is integrally formed with at least part of the structure which is used to achieve acoustic impedance matching. The integral acoustic impedance matching structure may be formed at either a rear face of a piezoelectric layer in order to reduce reflections at the rear face or at a front face in order to reduce reflections or achieve apodization of a radiating aperture.

In one embodiment, a previously formed piezoelectric member is "divided" into the transducer portion and the acoustic impedance matching portion. The division includes forming grooves into the thickness of the piezoelectric member. Typically, the grooves have a depth of one-quarter of the wavelength at the operational frequency of the transducer device, while that portion of the piezoelectric member without grooves has a thickness of one-half the operational frequency. A groove volume fraction is selected to control acoustic impedance and, optionally, apodization. Acoustic impedance can be controlled further by selection of a filler material to occupy the grooves.

The transducer portion of the piezoelectric member is poled to achieve the desired electromechanical properties for converting between electrical and acoustic wave energy. On the other hand, the piezoelectric material of the acoustic impedance matching portion remains substantially electromechanically inert. Electrodes that are formed on opposed sides of the piezoelectric structure may be used in the poling process.

Forming the grooves into the piezoelectric member may be accomplished by any of a variety of different techniques. For example, a microgroove impedance matching layer may be patterned into a portion of a piezoelectric block by utilizing laser-assisted chemical etching. Deep grooves having a width of 5 μm can be made in a piezoelectric ceramic. Optionally, a graded impedance matching layer can be formed by selectively varying the widths or depths of the grooves.

The grooves can also be formed in a piezoelectric block using a dicing saw. For example, a diamond-impregnated dicing wheel of the type used to dice integrated circuit chips from a processed silicon wafer may be employed to form microgrooves partially through a piezoelectric block.

Yet another alternative is to employ masking techniques to form the microgrooves. Photolithography together with jet-micromachining can also be used. A ceramic powder, such as lead zirconate titanate (PZT) powder, mixed with a binder may be pressed in green form into a desired shape. A suitable mask, such as a shadow mask or possibly a photoresist mask, is deposited on the piezoceramic in a desired pattern before the structure is fired. The mask covers first areas, but exposes those areas in which the microgrooves are to be formed. A jet spray is then used to dissolve away the binder and to remove the ceramic powder from the exposed areas. The piezoceramic is then fired. The electrodes can then be deposited and the transducer portion can be poled.

Rather than forming the grooves into a previously formed piezoelectric member, the piezoelectric material may be directly configured to include the grooves. A ceramic slurry of fine ceramic powder and binding agent may be poured into a mold and dried. By forming the mold of a suitable material, the mold may be lost during a firing process. The resulting structure, having a transducer portion and an acoustic impedance matching portion, can then be processed as desired. Using this technique, very fine structures, which would be difficult to make using the dicing process, can be fabricated. This technique also facilitates formation of graded impedance matching layers. Injection molding a slurry of ceramic powder and binding agent may also be used. Other acceptable molding techniques include pressing (e.g. uniaxial, biaxial and isostatic pressing) and green machining, which is a combination of pressing and machining.

Stacking piezoelectric members to form a single transducer element is also possible. Tape casting may be employed to form a laminated element, similar to formation of a multilayer capacitor. Two alternative approaches are thick film screen printing the individual layers and extending the individual layers. Piezoelectric members are assembled in contacting relationship and are arranged to vary in dimension such that the acoustic impedance matching portion is formed by regions of first piezoelectric members that extend beyond edges of second piezoelectric members. The thicknesses of the second piezoelectric members define the widths of the grooves.

In the preferred embodiment, the microgrooves are filled with a material to enhance the performance of the transducer device. For example, low viscosity polymer may be poured onto the structure having the microgrooves, whereafter the polymer is cured according to the requirements of the specific polymer, e.g., a thermosetting polymer or rubber. For a thermoplastic polymer, the polymer may be melted, applied to the microgrooves, and then cooled. Polymer alternatively may be solution cast or pressed into the structure. The filler material may be applied using a high pressure gas to force the material into the grooves. Vacuum force may alternatively be employed to force the filler material into the grooves so as to remove voids and air pockets. Surface tension may be utilized to introduce filler material into microgrooves of a carefully cleaned device. To maximize transducer performance, the filler material may be applied using a centrifuge process, in which separation of the components of the filler material by centrifugal force achieves a graded acoustic impedance matching with departure from the poled transducer portion of the device.

Electrodes are formed at the opposed sides of the device. Electrode material can be applied by sputtering, thermal evaporation deposition, thick film processing, plating or frit firing. An electrode may be formed to enter the microgrooves, but this is not critical. A conductive material, such as an electrically conductive polymer, may be used as the filler material, so that the filler material maintains direct current continuity. Alternatively, a polymer material having a high dielectric constant may be used, again reducing the need for an electrode to extend into the microgrooves.

An advantage of the invention is that the resulting structure has a relatively high dielectric constant. A high dielectric constant is desired, so that a high capacitive charging is sensed by the electrodes in response to reflected acoustic wave energy received by the transducer device. A high dielectric constant also provides an improved electrical impedance match between the transducer device and components of an imaging system that is electrically coupled to the device. Manufacturing advantages also exist. The microgrooves can be easily etched or cut into a wide range of piezoelectric materials. Furthermore, because the substantially inert impedance matching portion is integral with the transducer portion, impedance matching is achieved without burdensome manufacturing and reliability problems. High frequency performance of the transducer device is not limited by the presence of adhesive bond lines. Another advantage is that the acoustic impedance of an impedance matching structure can be easily controlled.

BEST MODE FOR CARRYING OUT THE INVENTION

Figure 1:
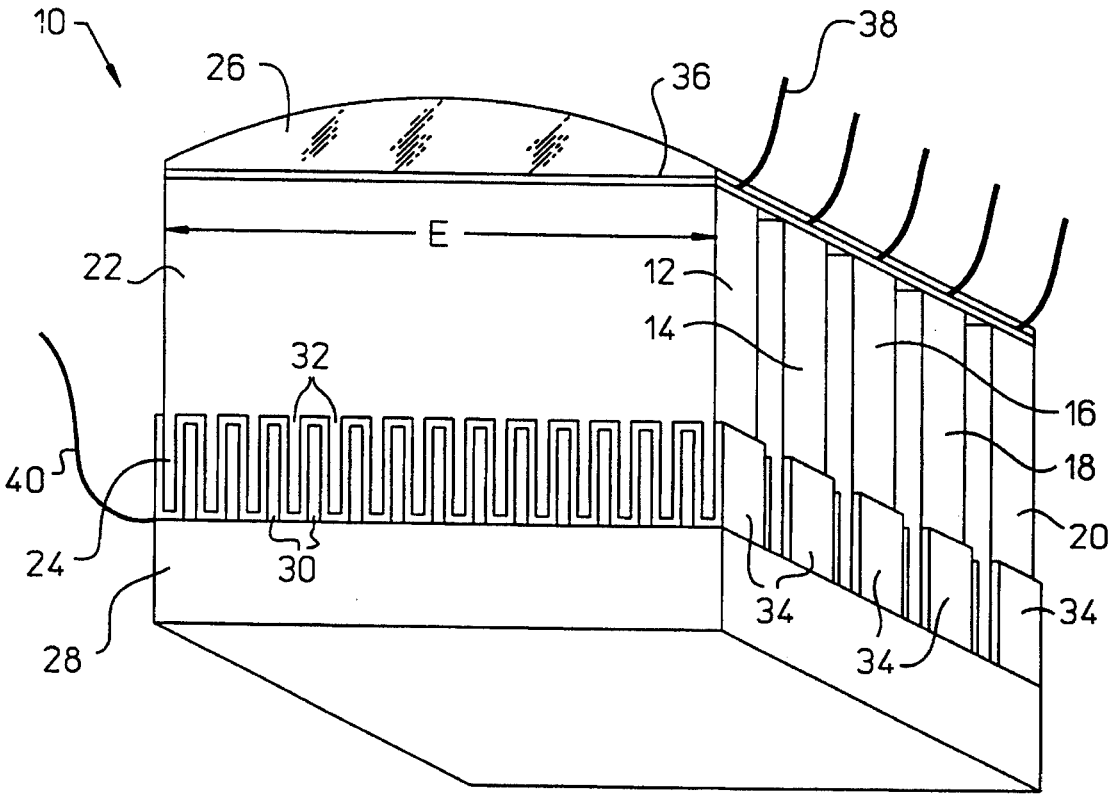
FIG. 1 is a perspective view of an ultrasonic transducer device with a back matching layer formed in accordance with the invention.

With reference to FIG. 1, an acoustic transducer device 10 is shown as including five piezoelectric elements 12, 14, 16, 18 and 20. Each of the piezoelectric elements includes a transducer portion 22 and an acoustic impedance matching portion 24. As will be explained more fully below, the two portions 22 and 24 are integrally formed. That is, the transducer portion 22 and piezoelectric regions of the acoustic impedance matching portion 24 are unitary.

Each piezoelectric element 12–20 has an elevation dimension, E, corresponding to an elevation aperture of the element. The elevation aperture and the resonant acoustic frequency of each element are selected in accordance with a desired imaging application. Typically, the elevation dimension, E, is selected to be between seven and fifteen wavelengths of the resonant acoustic frequency of the device 10. The transducer portion 22 has a thickness that is perpendicular to the elevation dimension. Conventionally, the thickness is equal to one-half of the resonant acoustic frequency of the device. The corresponding thickness of the acoustic impedance matching portion 24 is conventionally one-quarter wavelength of the resonant frequency.

The piezoelectric elements 12–20 are arranged in spaced apart relationship along an azimuthal dimension. While five piezoelectric elements are shown in FIG. 1, a transducer array typically includes a significantly greater number of elements. For example, an ultrasonic abdominal probe for a medical imaging application typically has more than one hundred elements, with each element having an elevation aperture of ten wavelengths. In the preferred embodiment, the piezoelectric elements 12–20 of the acoustic transducer device 10 are formed of lead zirconate titanate (PZT), but other piezoelectric materials may be employed in accordance with the principles of the invention. An acoustic lens 26 is acoustically coupled to the front faces of the elements to provide elevational focusing of the beam of acoustic energy transmitted from the device 10. The lens 26 at the front face and a support body, or backing, 28 at the opposite side of the device are used in a conventional manner. The support body is formed of an acoustically damping material.

Figure 2:
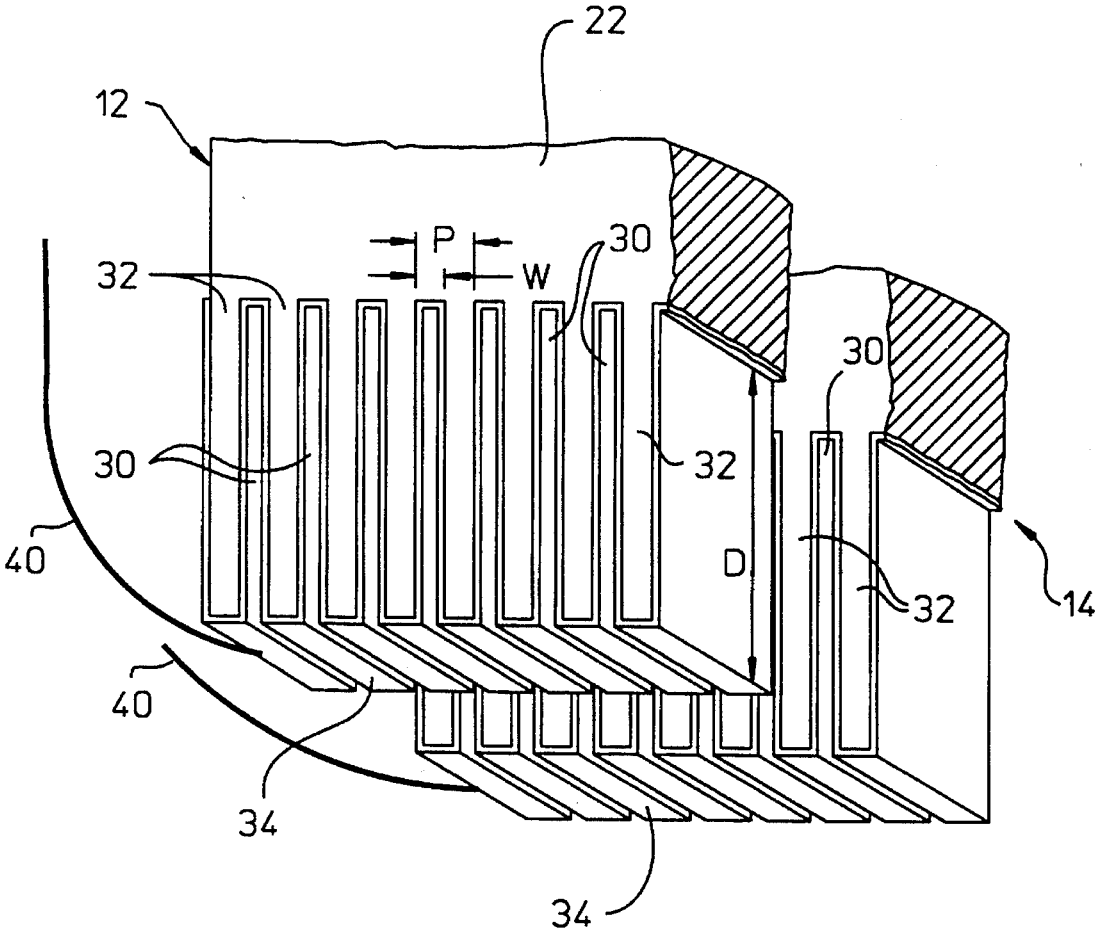
FIG. 2 is a perspective view of a portion of an acoustic impedance matching portion of FIG. 1.

Referring now to FIG. 2, sections of two of the transducer elements 12 and 14 are enlarged to show the acoustic impedance matching portions of the elements as including grooves 30 that have been formed into the piezoelectric layer 32 that is integral with the transducer portion 22. As will be explained more fully below, the piezoelectric material that forms the transducer portion 22 is electromechanically active, while the piezoelectric material of the layer 32 is electromechanically inert.

In the preferred embodiment, the grooves are arranged substantially parallel to one another along the elevation dimension of the piezoelectric elements 12 and 14. An electrically conductive electrode 34 follows the contour of the piezoelectric layer 32. Referring to FIGS. 1 and 2, the transducer device 10 includes a front electrode 36 between the piezoelectric elements 12–20 and the acoustic lens 26. In operation, a potential difference is applied across the active transducer portion 22 by means of the electrodes 34 and 36. Bond wires 38 and 40 may be used to conduct current to and from the device 10.

A conformal material resides within the grooves 30. In the embodiment of FIGS. 1 and 2, the conformal material is air, so that the rear electrode 34 must enter into the grooves. In a preferred embodiment, a filler material is selected to allow fabrication of a planar rear electrode. For example, a conductive polymer that provides continuity to the electromechanically active transducer portion 22 is used. Alternatively, a filler material having a high dielectric constant may be used, again allowing employment of a planar electrode.

By applying a potential difference across the electrodes 34 and 36, the transducer portion 22 of each piezoelectric element 12–20 is excited to produce acoustic waves having the desired resonant frequency. The acoustic waves from the individual piezoelectric elements of the array are emitted together to form beams of acoustic waves. The individual beams of the elements merge to form a single beam that is transmitted into a medium of interest, such as a patient's body. By controlling the phase of the electrical signals applied to the individual elements 12–20, azimuthal steering of the acoustic beams can be achieved. The acoustic lens 26 is used to provide elevational focusing of the beams.

AS the beam propagates through the patient's body, tissue structures that present a significantly different acoustic impedance than that of the medium surrounding the tissue structures will reflect acoustic energy. The reflected energy is received by the piezoelectric elements 12–20 and the operation of each transducer portion 22 generates an electrical signal that is sensed by the electrodes 34 and 36. The electrical signal is transmitted to an imaging system via the bond wires 38 and 40.

While an integrated matching layer having microgrooves can be used in the design of impedance matching layers at the front surface of a transducer, FIGS. 1 and 2 show the impedance matching portion 24 at the back surface. An impedance matching layer at the back surface, between the piezoelectric transducer portion 22 and the acoustically damping support body 28, may be used to control the amount of energy that is transferred into the support body at different frequencies. This gives a transducer design greater control over transducer impulse response. A portion of the acoustic energy generated by a transducer portion 22 of a piezoelectric element 12–20 will be rearwardly directed toward the acoustic impedance matching portion 24. The acoustic waves propagate through the transducer portion with a first velocity and through the inert piezoelectric layer 32 with a second velocity. The depth, D, of the grooves 30 into the piezoelectric material that form the two portions 22 and 24 defines the dimension of the inert piezoelectric layer 32. A width dimension, W, of each groove and a pitch dimension, P, of the grooves are selected to separate lateral and shear resonance modes of the inert piezoelectric layer 32 from undesired interaction with the longitudinal resonance mode of the transducer portion 22. Furthermore, the depth and pitch of the grooves are selected to provide efficient transfer of acoustic energy through the inert piezoelectric layer. Additionally, the width and pitch of the grooves are selected so that the inert piezoelectric layer appears homogeneous to acoustic waves. In general, beneficial results are produced by a pitch-to-depth ratio that is less than or equal to approximately 0.4. The depth and pitch dimensions of the grooves may be adjusted further so that for an electrical potential measurable between the pair of electrodes of each piezoelectric element 12–20, there is a relatively small electrical potential difference along the thickness of the inert piezoelectric layer. For example, the width and depth dimensions of the grooves may be selected so that there is an electrical potential difference along the thickness of the piezoelectric layer that is less than approximately five percent of the electrical potential measurable between the respective pair of electrodes of each element.

The acoustic impedance of the impedance matching portion 24, $Z_{back\ layer}$, of the transducer device 10 is controlled so as to provide an acoustic impedance match between the bulk acoustic impedance of each piezoelectric element, $Z_{PZT}$, and the acoustic impedance of the damping support body 28, $Z_{backing}$. Alternatively, the integrated impedance matching layer having microgrooves can be employed in the design of a front impedance matching layer. An impedance matching layer at the front surface provides an efficient transfer of acoustic energy from the piezoelectric layer into the medium of interest, e.g., human tissue. An example of the back impedance matching layer is given here, but similar calculations are performed for the design of a front impedance matching layer. The acoustic impedance of the inert piezoelectric layer is substantially determined by the groove volume fraction of the impedance matching portion 24, which is based upon the width and pitch dimensions of the grooves 30. The desired acoustic impedance of the impedance matching portion may be calculated using the equation:

$$Z_{back\ layer}=(Z_{PZT}\times Z_{backing})^{1/2}.$$

For example, given an acoustic impedance of the damping support body, $Z_{backing}$, as $3\times10^6$ kg/m$^2$s, and a bulk acoustic impedance of lead zirconate titanate, $Z_{PZT}$, as $33\times10^6$ kg/m$^2$s, the desired acoustic impedance of the impedance matching portion 24, $Z_{back\ layer}$, is calculated to be approximately $9.95\times10^6$ kg/m$^2$s.

As previously noted, the acoustic impedance of the impedance matching portion 24 of each piezoelectric element 12–20 is substantially controlled by the groove volume fraction of the impedance matching portion. The groove volume fraction is defined by dividing a volume of a groove extending through the portion by the sum of the volumes of the groove and the piezoelectric material in the layer 32 adjacent to the groove. A desired groove volume fraction, v, is calculated from the desired acoustic impedance of the layer and the acoustic impedances of the piezoelectric ceramic layer and the conformal filler material within the grooves 30. The desired groove volume fraction may be calculated using the following equation:

$$V_{groove}=(Z_{PZT}-Z_{back\ layer})/(Z_{PZT}-Z_{filler}).$$

For example, given air as the conformal filler material having an acoustic impedance, $Z_{filler}$, of 411 kg/m$^2$s, and given the values of $Z_{back\ layer}$ and $Z_{PZT}$ set forth above, the desired groove volume fraction of the impedance matching portion 24 is approximately 69.8 percent. Thus, the PZT volume fraction is 30.2%.

A desired depth of the grooves 30, D, is calculated from the speed of sound in the inert piezoelectric layer 32, $C_{layer}$, and a quarter wavelength of the resonant acoustic frequency, f, of the piezoelectric element 12–20, using the equation:

$$D=\tfrac{1}{4}(C_{layer}/f).$$

Given that the desired groove volume fraction of the acoustic impedance matching portion 24 is approximately 69.8 percent, the speed of acoustic waves in the impedance matching portion can be estimated as approximately $C_{layer}$= 3500 meters/second. Analytical models discussed in "Modeling 1–3 Composite Piezoelectrics: Thickness-Mode Oscillations," Smith et al , pages 40–47 of *IEEE Transactions on Ultrasonics, Ferroelectrics, and Frequency Control,* Vol. 38, No. 1, January 1991, can be adapted to estimate the speed of sound in an insert piezoelectric layer. If the resonant acoustic frequency, f, is 2 MHz, the depth of the grooves is approximately D=437.5 microns. Accordingly, the grooves are microgrooves, extending into the rear face of the piezoelectric element less than 1000 microns.

The pitch, P, of the grooves 30 is calculated to be equal to or less than 0.4 of the depth of the grooves:

$$P\leqq(0.4\times D).$$

For example, given depths of the grooves of approximately 437.5 microns, the pitch of the grooves should be less than or equal to 175 microns. The width of the grooves, W, is calculated based upon the pitch, P, the groove volume fraction, v, and the connectivity of the piezoelectric composite. Given 2–2 connectivity, a pitch of 175 microns, and a groove volume fraction of 69.8 percent, the width, W, of the grooves 30 is approximately 122.1 microns. A description of different connectivity schemes can be found in "Connectivity and Piezoelectric-Pyroelectric Composites, " by R. E. Newnham et al., *Materials Research Bulletin*, Vol. 13, pp. 525–536, 1978, Pergamon Press, Inc.

For embodiments of an acoustic transducer device 10 that is scaled to operate at a higher resonant frequency, relevant groove dimensions are scaled accordingly. For example, for an embodiment in which the device is to operate at a resonant acoustic frequency of 20 MHz, relevant groove dimensions of the 2 MHz device discussed previously are scaled by a factor of 10. Therefore, for an array of piezoelectric elements 12–20, with each element having a bulk resonant frequency of 20 MHz and an inert piezoelectric layer 32 having grooves 30 arranged with 2–2 connectivity, relevant dimensions of the grooves are scaled down by 10, so as to have a pitch of 17.5 microns, a width of 12.2 microns, and a depth of approximately 43.8 microns.

The number of "teeth" within the piezoelectric layer 32 of the impedance matching portion 24 is related to the pitch of the grooves 30 and the elevation dimension E. Typically, the number of grooves in a set of grooves along the elevation dimension is within the range of 50 to 200 grooves in order to produce the beneficial impedance matching results. As an example, for a given preferred elevation dimension, E, of 10 wavelengths, a preferred number of grooves along the elevation dimension is approximately 100.

In FIGS. 1 and 2, the rear electrodes 34 extend into and contact the grooves, imposing electrical boundary requirements to support a desired electrical field distribution within each piezoelectric element 12–20. As will be explained more fully below, preferably the conformal filler material is selected so that the rear electrode can be planar, rather than serpentine as shown in FIGS. 1 and 2. For example, the filler material may be electrically conductive, such as a conductive polymer, thereby providing the electrical continuity to the regions inside the grooves of each piezoelectric element 12–20. Alternatively, a filler material having a high dielectric constant may be selected, so that there is a capacitive coupling to the regions inside the grooves, and consequently to the transducer portion 22. Such a capacitive coupling eliminates the need for an electrode with D.C. continuity or an electrode which might be required to be continuous across the entire surface of PZT.

Design parameters, such as the width and pitch dimensions of the grooves 30 having a given depth, may be adjusted so that when there is an electrical potential difference measurable between the electrodes 34 and 36, there is a relatively small potential difference along the thickness of the impedance matching portion 24. For example, the width and pitch dimensions of the grooves may be selected so that a potential difference along the thickness of the piezoelectric layer 32 is less than five percent of the electrical potential difference measurable between the electrodes 34 and 36. It should be understood that for ultrasonic probes there are several relevant sources of the electrical potential difference measurable between the electrodes 34 and 36. One relevant source of an electrical potential difference across the electrodes is the signal source used to excite acoustic signals within the piezoelectric elements 12–20. Another relevant source is the voltage induced in each piezoelectric element by receiving reflected acoustic signals from a body of interest.

Figure 3:
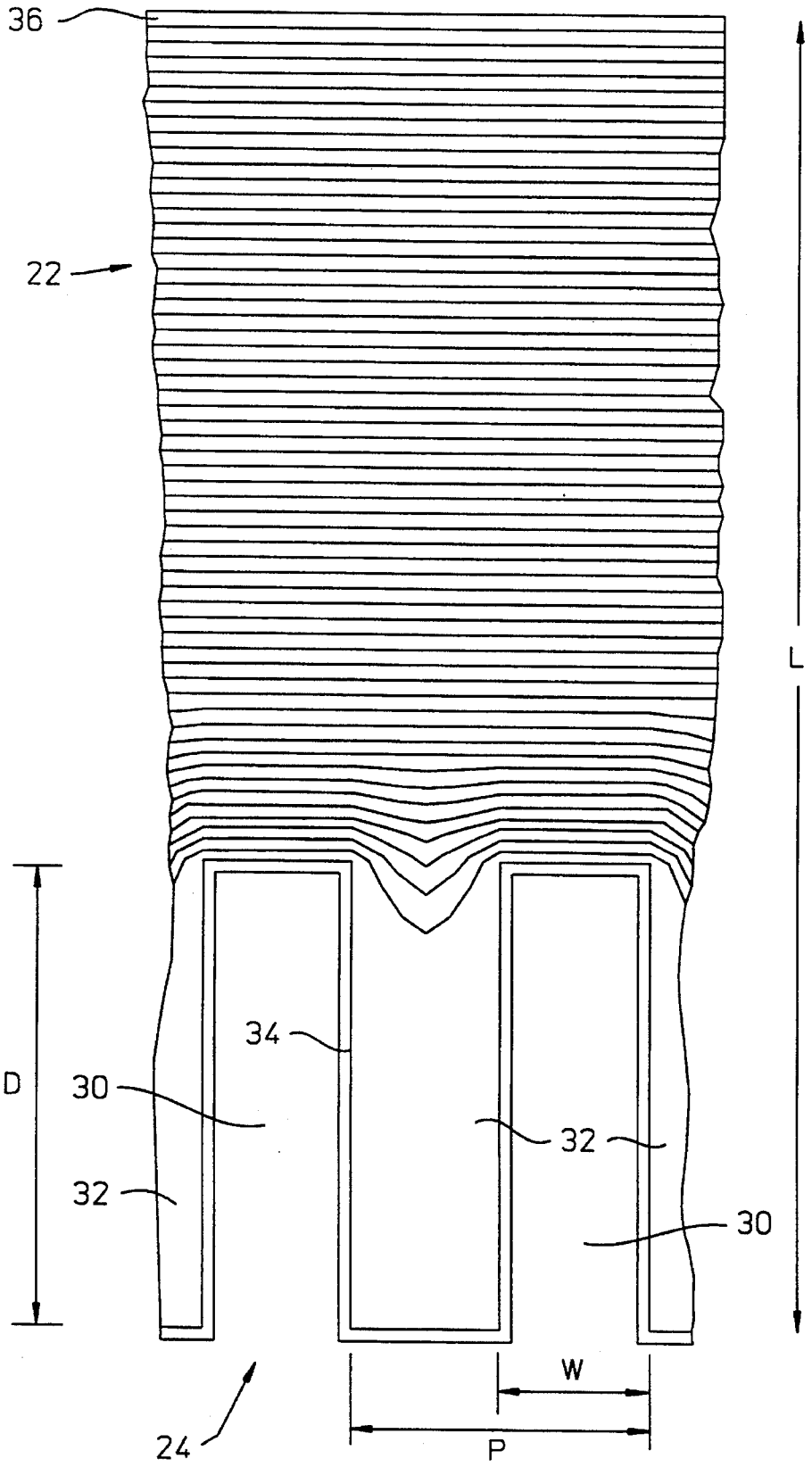
FIG. 3 is a diagram illustrating lines of electrical equipotential distributed along a longitudinal dimension of a piezoelectric element of FIG. 1.

Referring now to FIG. 3, a series of lines representing lines of electrical equipotential within the transducer portion 22 and the impedance matching portion 24 of a piezoelectric element are shown. Throughout almost the entirety of the transducer portion, the lines of equipotential are perpendicular to the thickness, L, of the element. Given an exemplary one volt potential difference between the electrodes 34 and 36, the lines of equipotential correspond to 0.01 volt increments. There is a relatively small electrical potential difference between the thickness of the inert piezoelectric layer 32 that is approximately three percent of the electrical potential across the electrodes 34 and 36. Because the electrical potential difference along the thickness of the inert piezoelectric layer is relatively small, the dielectric constant measurable between the electrodes is substantially the same as that which is intrinsic to the PZT material of the element. That is, the dielectric constant is relatively high. Furthermore, the relatively small potential difference along the thickness of the inert piezoelectric layer further helps to ensure that the layer is substantially electromechanically inert.

Upon the piezoelectric element receiving acoustic signals from a medium of interest, capacitive charging of the electrodes 34 and 36 is driven by a displacement current. The displacement current is linearly proportional to a product of the electrical potential measurable between the pair of electrodes and the dielectric constant. Accordingly, the relatively high dielectric constant provides a relatively high capacitive charging. The high capacitive charging efficiently transmits signals to imaging system components, which analyze a relative temporal delay and intensity of weakly reflected acoustic signals received by the transducer device and electrically sensed by the electrodes. From the analysis, the imaging system extrapolates a spaced relation of the various structures of the medium of interest which reflect acoustic energy.

Figure 4:
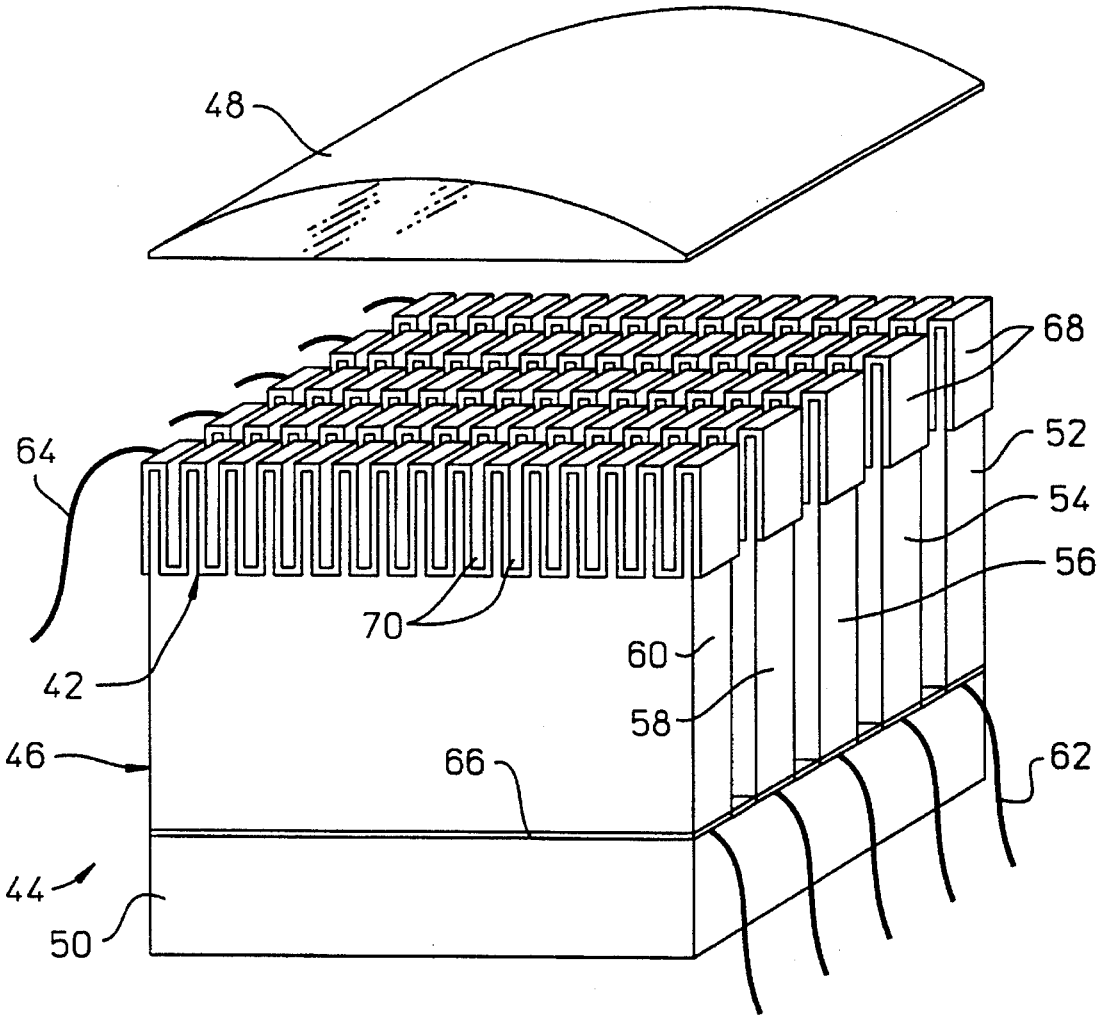
FIG. 4 is a perspective, partially exploded view of an embodiment in which an impedance matching layer is at a front face of a transducer, wherein the layer is formed in accordance with the invention.

FIG. 4 illustrates a second embodiment of the invention. In this embodiment, an acoustic impedance matching portion 42 of a transducer device 44 is on a side of a transducer portion 46 near the acoustic lens 48. Thus, the structure for providing an impedance match is positioned to more efficiently couple the device to a medium of interest in which acoustic wave energy is to be transmitted and received. A damping support body 50 is connected directly to rear surfaces of piezoelectric elements 52, 54, 56, 58 and 60 of an array of elements. Bond wires 62 and 64 are used to connect electrodes 66 and 68 to drive circuitry and to an imaging system.

The construction of the impedance matching portion 42 of the transducer device 44 follows the same principles described above. Thus, grooves 70 are formed to have dimensions which allow the impedance matching portion to have an acoustic impedance between the impedance of the transducer portion 46 and that of the medium of interest. The calculations of the groove volume fraction and the pitch and widths of the grooves 70 follow the equations set forth above.

Figure 5:
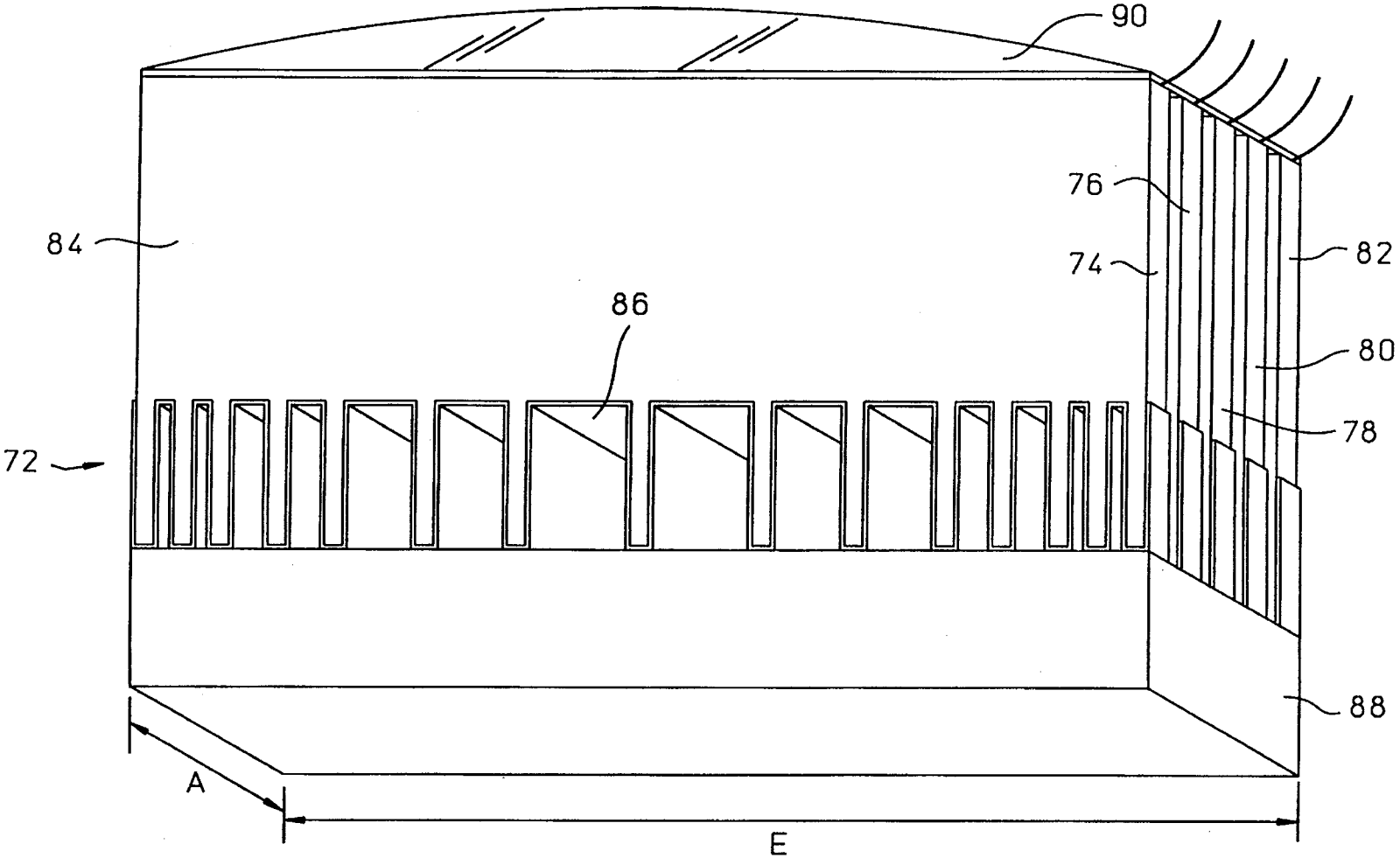
FIG. 5 is a perspective view of an impedance matching portion that provides spatial apodization along an elevation plane in accordance with the invention.

A third embodiment is shown in FIG. 5. Apodization of an elevation aperture is achieved by varying the groove volume fraction of an impedance matching portion 72 along the elevation dimension, E, of each piezoelectric element 74, 76, 78, 80 and 82 in accordance with a suitable apodization function, such as a hamming function. The width of each groove may be changed incrementally with distance from the center of the elevation dimension. Alternatively, adjacent grooves may be grouped into a number of zones along the elevation dimension, with the width of each group being varied relative to adjacent groups. As previously noted, the groove volume fraction of the impedance matching portion 72 controls the acoustic impedance of the piezoelectric layer. Acoustic impedance, in turn, determines a normalized sensitivity of the transducer device. Accordingly, apodization provides a desired normalized sensitivity profile along the elevation aperture.

Figure 6:
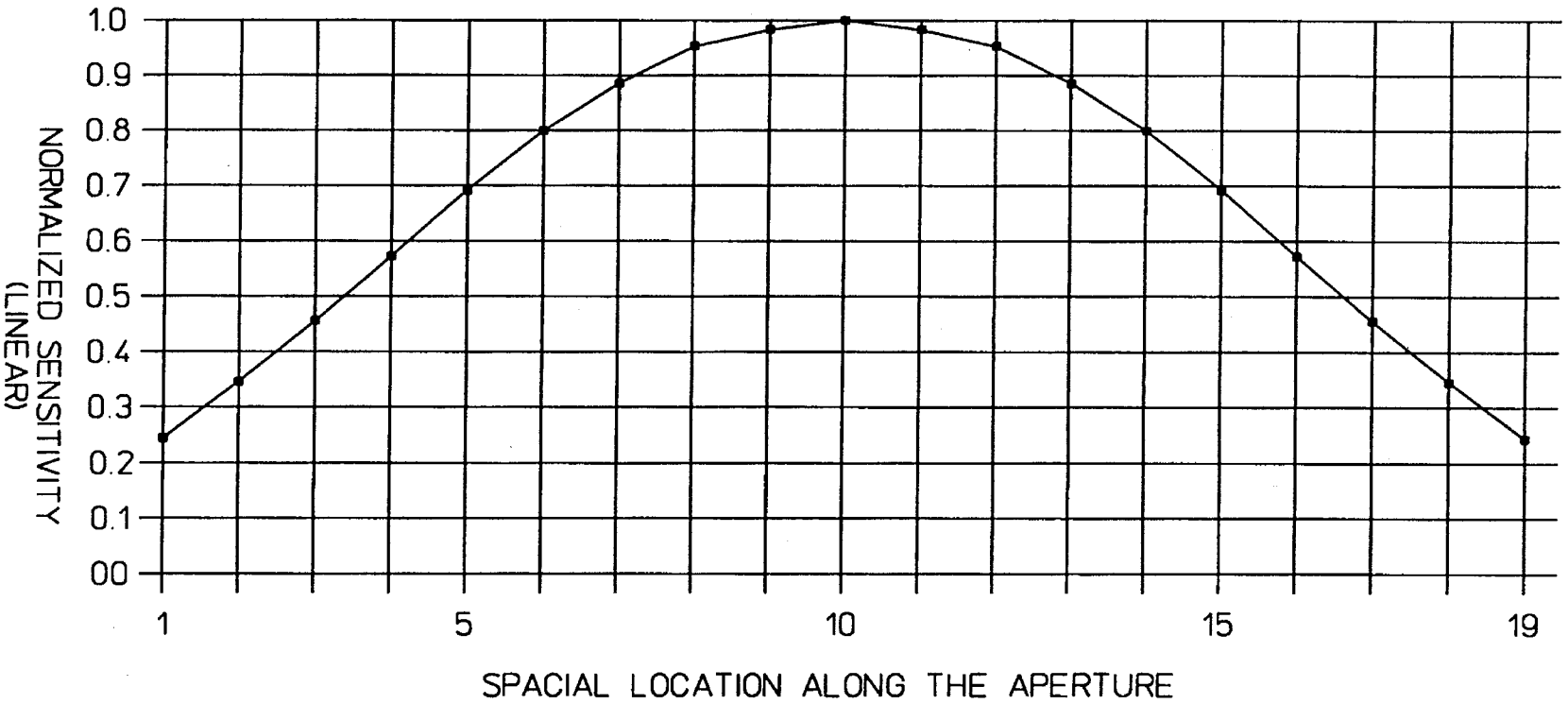
FIG. 6 is a diagram showing a desired normalized sensitivity versus spatial location along nineteen illustrative zones of an elevation aperture of a piezoelectric element, in accordance with a suitable apodization function.
Figure 7:
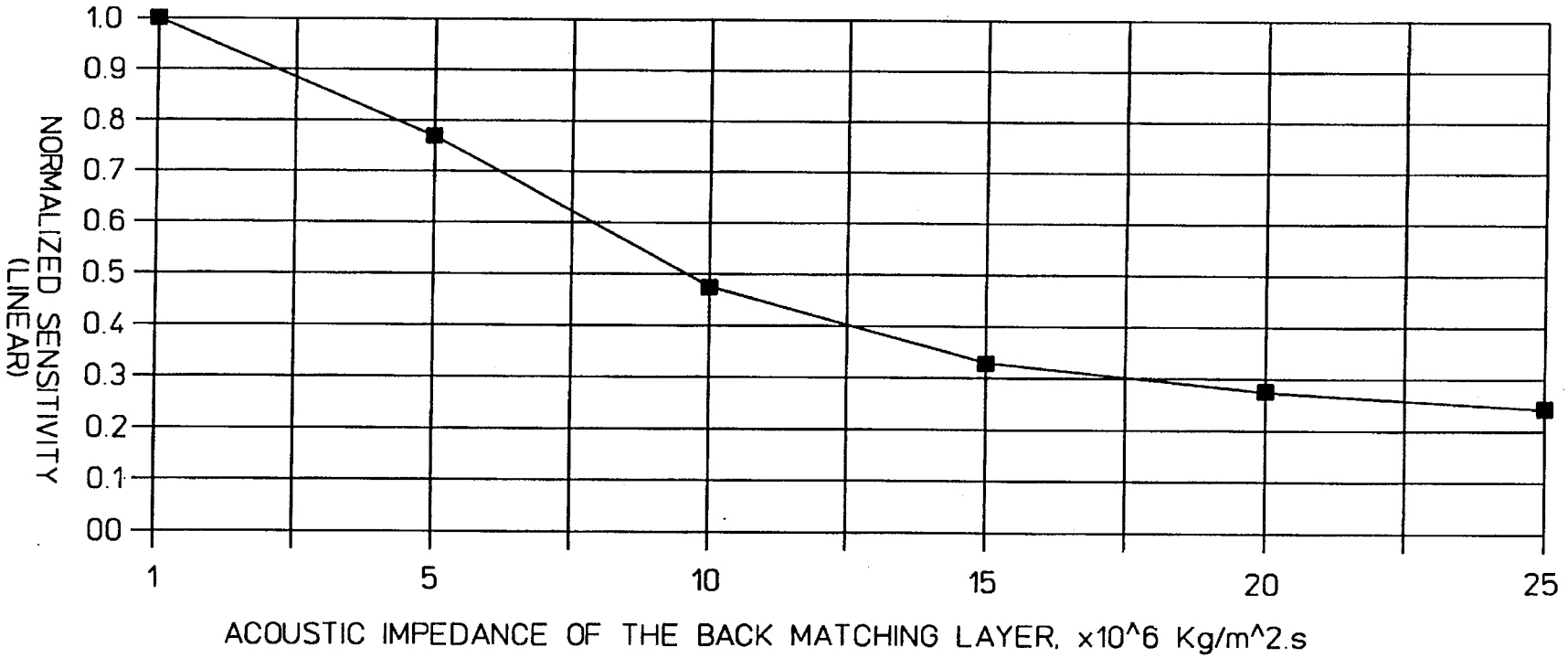
FIG. 7 is a diagram showing normalized sensitivity of a transducer device versus acoustic impedance of an integral impedance matching portion formed in accordance with the invention.
Figure 8:
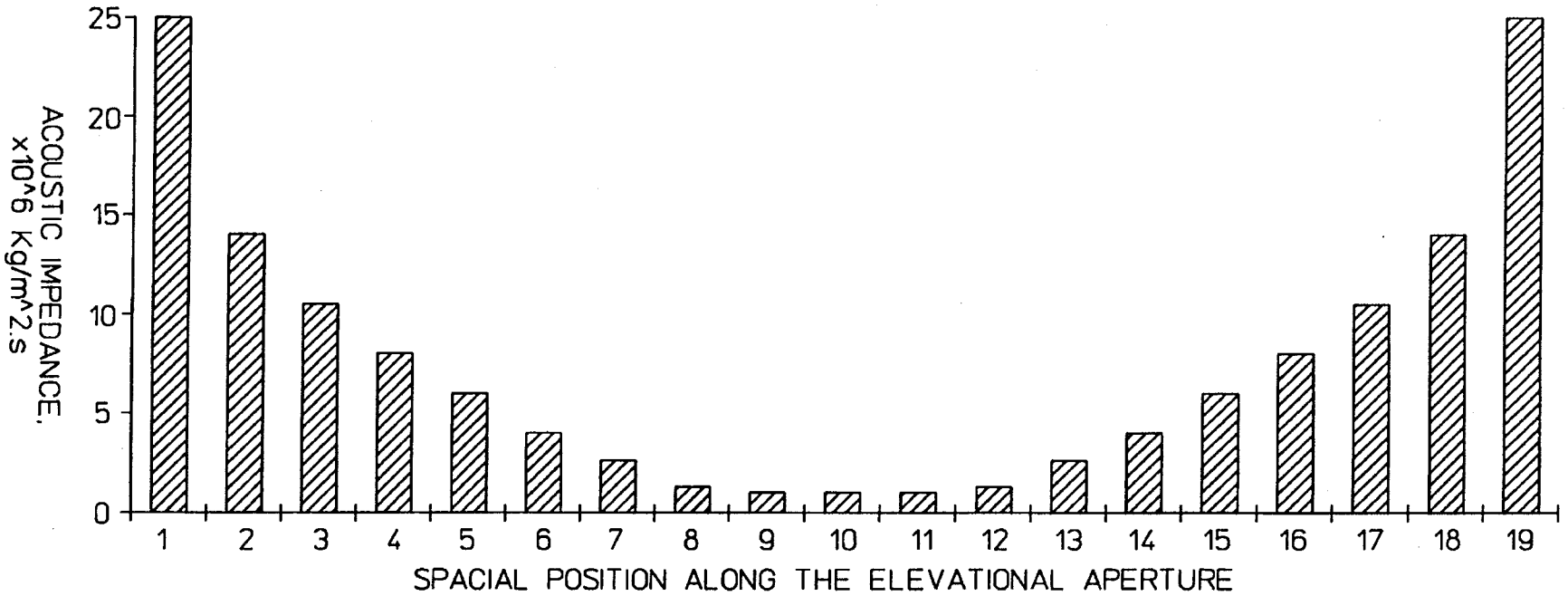
FIG. 8 is a diagram showing acoustic impedance of an impedance matching layer versus spatial location along the nineteen zones of the elevation aperture of FIG. 6.

For example, FIG. 6 is a diagram showing a desired normalized sensitivity versus spatial location along nineteen illustrative zones of an elevation aperture of each piezoelectric element of an array of elements. It should be understood that the number of zones actually used may be larger or smaller than nineteen. In general, a larger number of zones is preferred. FIG. 7 is a diagram showing how normalized sensitivity of the transducer device relates to acoustic impedance of the inert piezoelectric layer that is integral with a rear face of an active transducer portion 84. An acoustic impedance profile may then be derived from FIGS. 6 and 7, in accordance with the apodization function. For example, FIG. 8 is a diagram showing acoustic impedance of the impedance matching portion versus spatial location along the nineteen zones of the elevation aperture. Using the equation set forth above for determining a desired groove volume function, i.e., $V_{groove}=(Z_{PZT}-Z_{back\ layer})/(Z_{PZT}-Z_{filler})$, the desired groove volume function is calculated for each of the nineteen zones. The pitch and the width of grooves 86 may be individually calculated using the formulas set forth above for determining P and W. Apodization provides a tailored impedance match to a damping support body 88. Alternatively, a tailored impedance match may be provided between the active transducer portion 84 and an acoustic lens 90.

Figure 9:
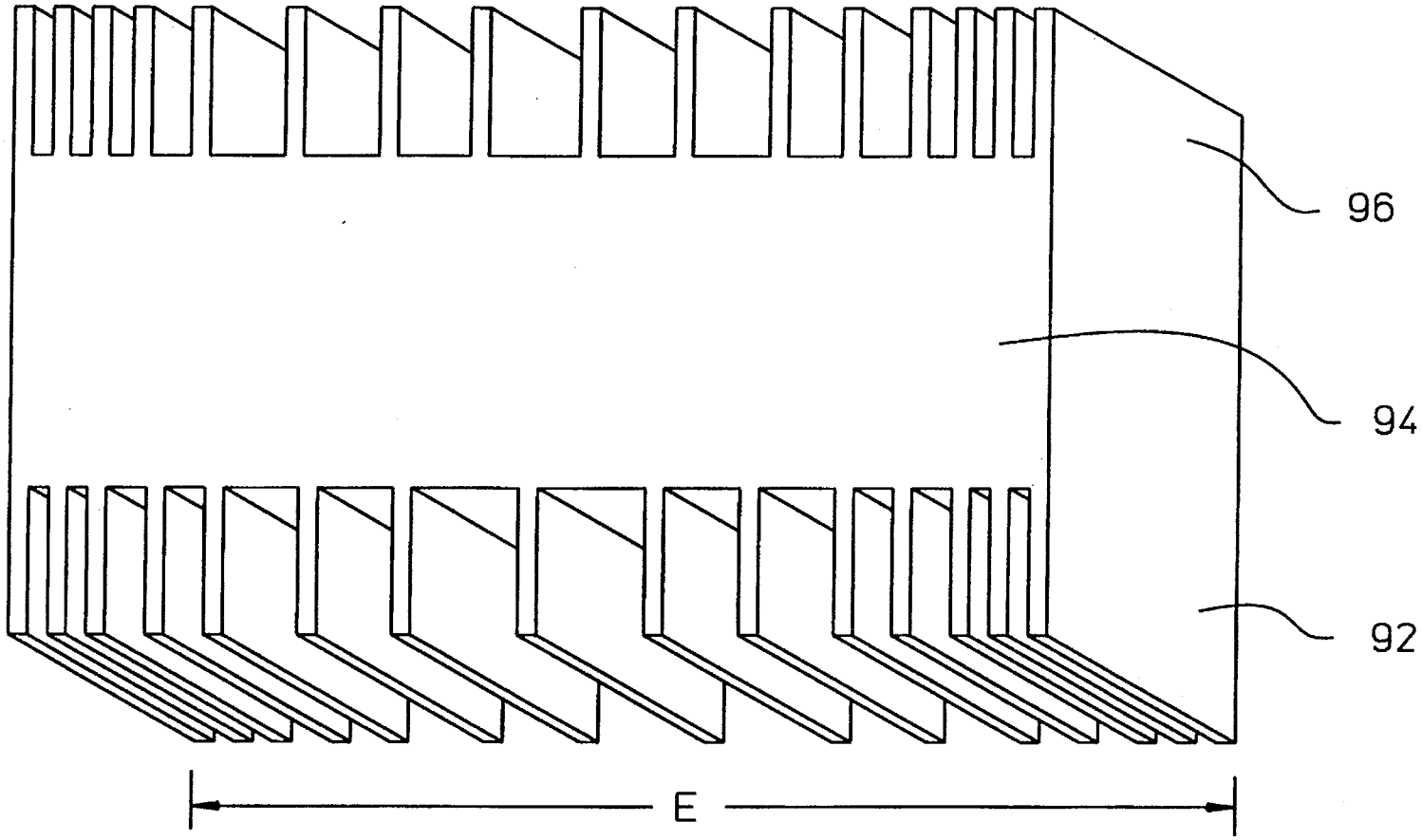
FIG. 9 is a perspective view of a transducer device having impedance matching portions with spatial apodization on opposed sides of a transducer portion, in accordance with the invention.

In the embodiment of FIG. 9, apodization is effected by a first inert piezoelectric layer 92, i.e. backed matching layer, that is integral with a rear face of a transducer portion 94 of a piezoelectric element, and is further effected by a second inert piezoelectric layer 96, i.e. front matching layer, at the front face of the transducer portion. Sets of grooves extend through the thicknesses of the first and second inert piezoelectric layers. A groove volume fraction of each inert piezoelectric layer 92 and 96 varies in accordance with the apodization function as described in referring to FIGS. 6 and 8. However, persons skilled in the art understand that normalized sensitivity as shown in FIG. 7 is different with respect to the front face. The differences should be taken into account in determining relevant groove dimensions for forming a front acoustic impedance matching layer as shown by the second inert piezoelectric layer 96 in FIG. 9.

While the first and second inert piezoelectric layers 92 and 96 are shown as having similar configurations, this is not critical. The grooves of the first inert piezoelectric layer 92 may be formed according to a first apodization function, while the groove volume fraction of the second inert piezoelectric layer 96 is varied along the elevation aperture, E, in accordance with a second apodization function. As another alternative, the second inert piezoelectric layer 96 that is integral with the front face of the transducer portion 94 may be used in a manner other than to provide apodization. For example, focusing of the individual beams emitted from an array of piezoelectric elements may be achieved by varying the groove volume fraction of the front matching layer 96 along the elevation dimension of each piezoelectric element. The variations may be in accordance with a suitable focusing function, such as a quadratic function. Just as the groove volume fraction controls acoustic impedance of the front matching layer 96, the groove volume fraction controls velocity of acoustic waves to the layer. Acoustic velocity through the layer controls time delay of acoustic signals propagating through the layer. Controlling time delay may be used to focus the acoustic waves.

Figure 10:
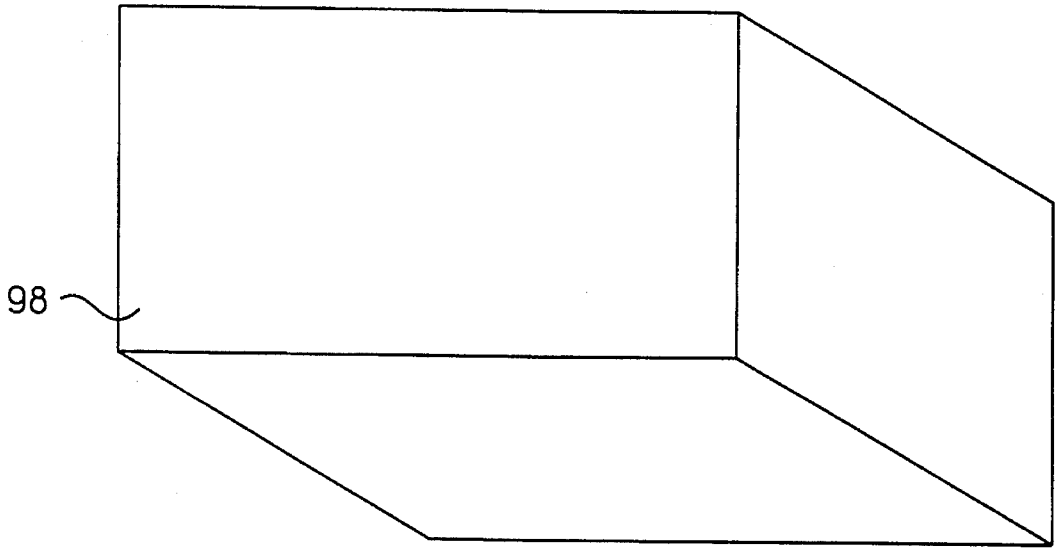
FIGS. 10 and 11 are perspective views of process steps for forming an integral impedance matching portion in accordance with the invention.

In one embodiment, fabricating one or more piezoelectric elements having unitary transducer and impedance matching portions begins with a piezoelectric member 98, such as the block shown in FIG. 10. The member 98 is a block of raw piezoelectric ceramic material. Since the raw material has not yet been poled, there is only random alignment of individual ferroelectric domains within the material. Thus, the material is electromechanically inert. PZT is a suitable candidate, but the selection of the material is not critical and may be made in accordance with desired properties of the transducer device to be fabricated.

The piezoelectric member 98 preferably has a thickness, or depth, that is three-quarters wavelength of the desired frequency of acoustic waves to be generated by the transducer device. Conventionally, a piezoelectric layer of a transducer device has a thickness of one-half wavelength. In FIG. 10, the additional one-quarter wavelength is provided to accommodate formation of an integral impedance matching layer. If an impedance matching layer is to be formed on each of the opposed major sides of a transducer portion, the piezoelectric member 98 should have a thickness of one wavelength of the desired resonant frequency.

Figure 11:
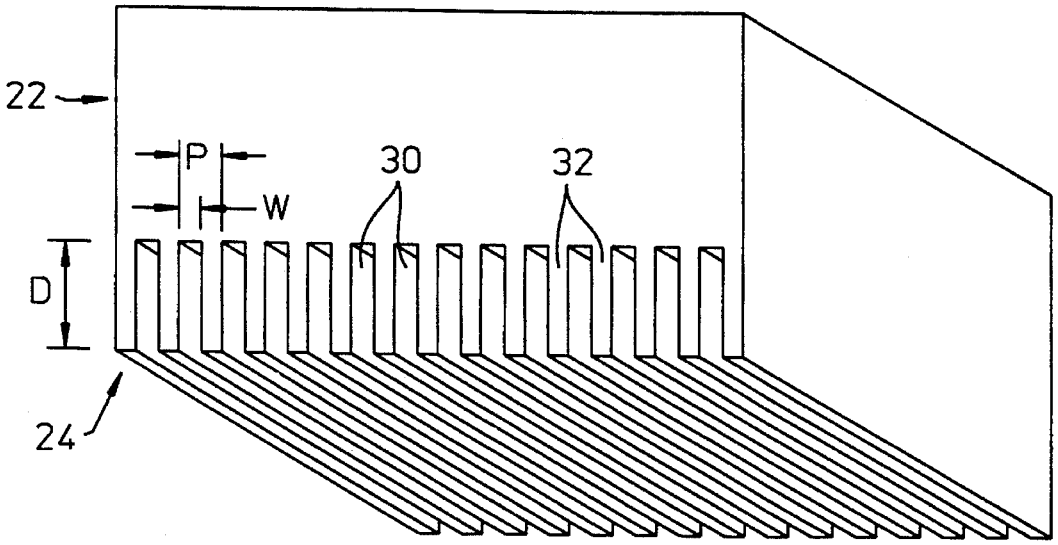

Referring now to FIG. 11, a series of grooves 30 have been formed into the rear face of the piezoelectric member to define an impedance matching portion 24 and a transducer portion 22. The impedance matching portion is a comb-like structure of a piezoelectric layer 32. The piezoelectric layer has a depth, D, and the grooves 30 are shown as having a width, W, and a pitch, P, which are formed in accordance with the considerations described above.

In one embodiment, the grooves are formed by using dicing wheels of the type used in the semiconductor industry to separate a silicon wafer into a number of integrated circuit chips. Diamond impregnated dicing wheels may be used to cut into the piezoelectric material to the selected depth. The width of the dicing wheel corresponds to the desired width, W, of the grooves 30.

Figure 12:
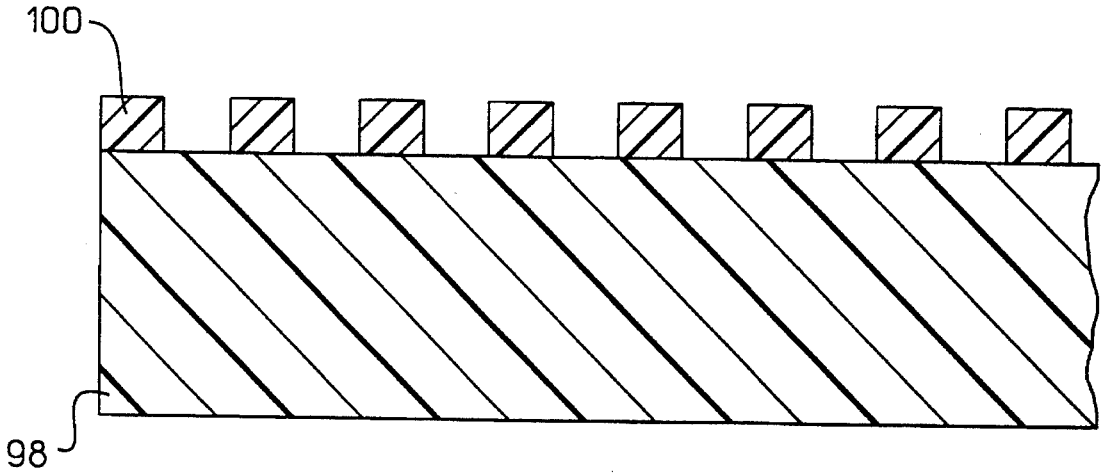
FIG. 12 is a side sectional view of a masking step for forming the structure of FIG. 11.

In an alternative embodiment, the process for forming the grooves utilizes photolithographic techniques. In FIG. 12, a masking layer 100 has been deposited and patterned onto the rear face of the inverted piezoelectric member 98. Regions of the piezoelectric material that are exposed between regions of masking material can be chemically etched to a desired pitch and depth. A difficulty with this process is that forming the grooves to have sides that are perpendicular to the sides of the piezoelectric member is difficult. Laser-assisted chemical etching provides better results. Using laser cutting techniques, a piezoelectric ceramic member 98 may be cut using a laser beam, such as a beam from an excimer laser, to form microgrooves having a width, W, as small as five microns. Graded impedance matching layers of the types shown in FIGS. 5, 16, 18 and 19 may be readily formed using this technique.

As will be explained more fully immediately below, molding techniques may be used to form the desired complex shape. Thus, any of the approaches of injection molding, extrusion, slip casting, hot or cold pressing (uniaxial, biaxial or isostatic pressing) may be utilized. "Green machining" is another alternative, i.e., combining pressing and machining prior to firing the ceramic.

The piezoelectric member 98 of FIG. 12 is a piezoceramic member that has been pressed in green form and has not been subjected to firing. A suitable masking layer 100, such as a shadow mask or even a photoresist mask is patterned and deposited. Alternatively, the mask can be press fit to the piezoceramic member. A suitable jet spray may then be used to dissolve away the binder material of the slurry used to form the member. The ceramic powder of the slurry is removed from the exposed regions, without removing the masking layer 100. The piezoceramic can then be fired. Fine-pitch structures, such as those obtained using the dicing process, can be obtained using this method.

Figure 13:
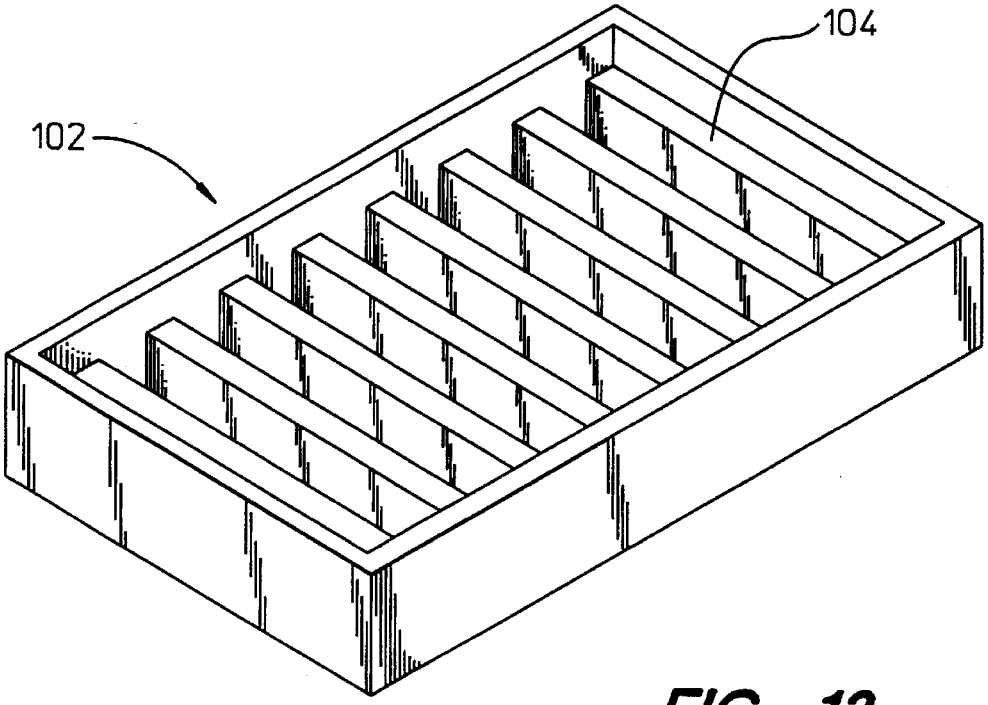
FIG. 13 is a perspective view of a mold for forming the structure of FIG. 11.

Referring now to FIG. 13, integral transducer and impedance matching portions may be formed using a mold 102. For example, a lost mold technique may be used in which a slurry of ceramic powder and fluid binder is poured into the mold 102 and dried. The mold is made of a material, such as a plastic, which is lost during the firing process. Fine-pitch structures may be formed using this process. Moreover, graded impedance matching layers in which grooves vary in depth, pitch or width can be readily formed. The impedance matching portion of the structure is defined by members 104 which extend along the bottom portion of the mold 102. Thus, the limitation with regard to forming the fine-pitch structure is imposed by the technique for forming the mold 102.

Alternatively, the integral transducer and impedance matching portions may be formed using injection molding. A slurry of ceramic powder and binding agent is injection molded into the desired shape. The material is then dried and removed from the mold. The formed piezoceramic is then fired.

It is also possible to extrude the slurry of ceramic powder and binding agent to form the desired structure. The extruded green ceramic is then fired to provide the final piezoceramic device having the integral impedance matching layer. Again, using this technique graded impedance matching layers having grooves that vary in one or more of depth, pitch and width can readily be formed.

The complex shape of piezoelectric material can also be formed by stacking piezoelectric layers. As will be explained below with reference to FIG. 17, layers can alter in length to form a selected complex structure. Each layer may be extruded onto a previously extruded layer until the complex structure is formed. In a like manner, layers may be sequentially formed onto other layers by screen printing techniques. Alternatively, a stacked structure can be constructed in a manner similar to multilayer capacitors, e.g., tape casting and laminating.

Figure 14:
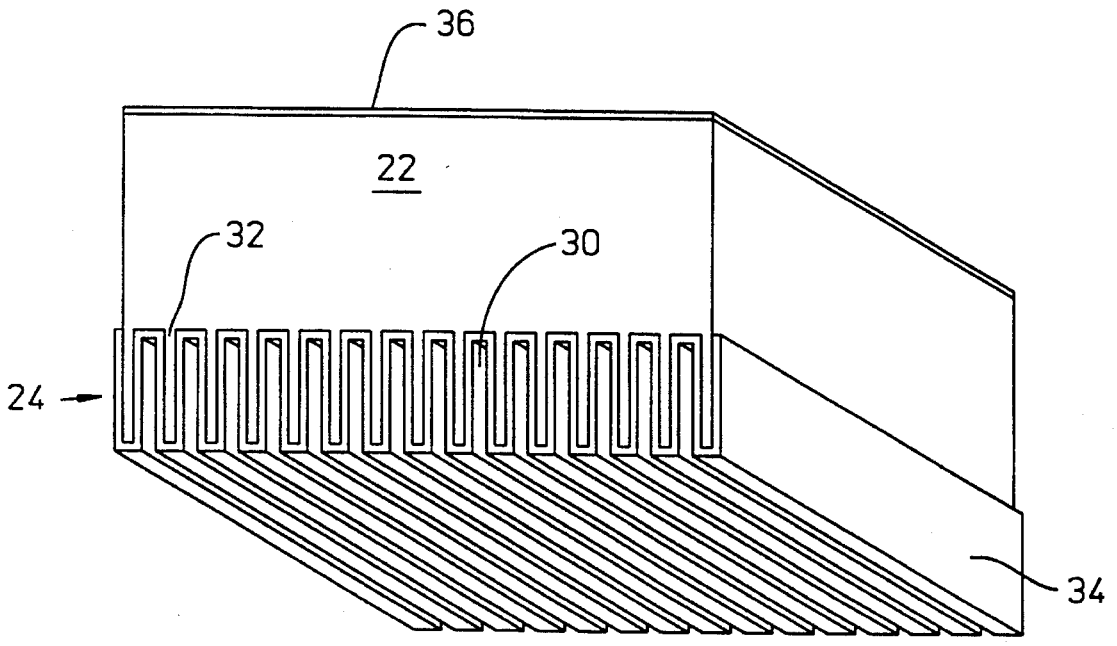
FIG. 14 is a perspective view of the structure of FIG. 11 having electrodes formed on opposed sides.

After the complex piezoelectric structure is formed, electrodes are deposited for subsequent poling and electrically exciting the piezoelectric material. Referring now to FIG. 14, metal electrodes 34 and 36 are deposited onto the opposed sides of the piezoelectric structure. A thin metal film having a selected thickness between approximately 1000 and 10000 angstroms may be formed onto the front and rear surfaces of the piezoelectric structure. In the embodiment of FIG. 14, the rear electrode 34 extends into and contacts the grooves 30, but this is not critical. Various thin film metallization techniques can be used to deposit the electrodes, including sputtering (diode magnetron and ion sputtering), thermal evaporation deposition (ion-beam assisted, filament and e-beam for line-of-sight deposition of the top electrode), plating (electro or electroless) and frit firing. While less desirable in some applications, thick film metallization techniques may be used, e.g. painting and spraying.

While the rear electrode 34 may follow the serpentine pattern shown in FIGS. 1 and 14, preferably an electrode at the impedance matching portion is a planar electrode. The serpentine pattern requires use of a metal having a good step coverage. Requiring the electrode to follow a contour as shown in FIGS. 1 and 14 is associated with some potential for electrical discontinuities. Referring now to FIG. 11, the grooves 30 are preferably filled with a material that allows use of a planar electrode to develop the required potential difference across the transducer portion 22.

Figure 15:
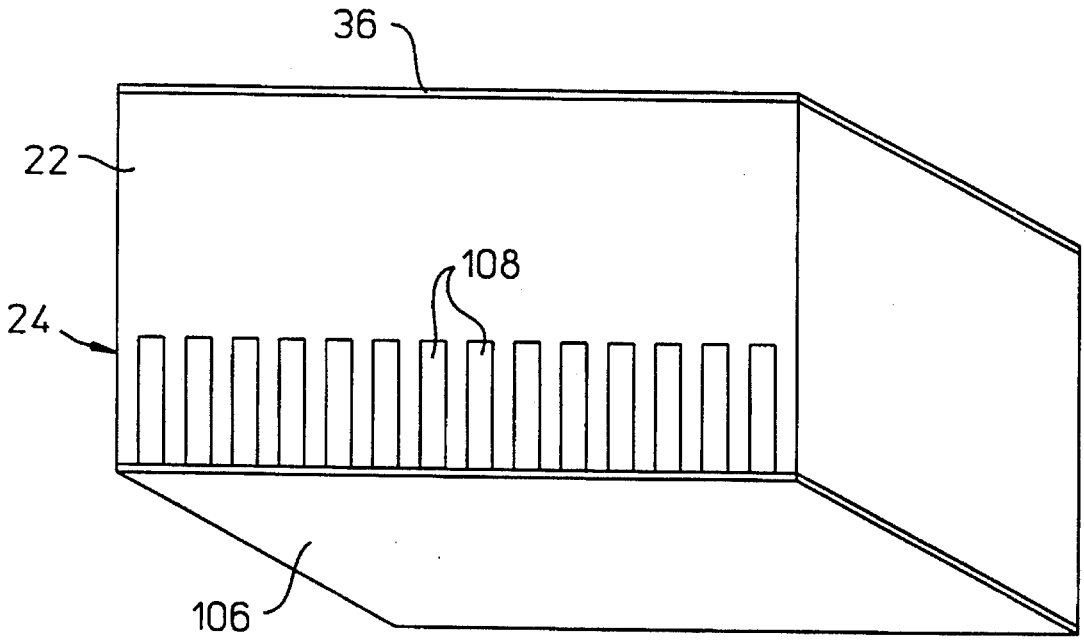
FIG. 15 is a perspective view of a second embodiment for forming opposed electrodes.

In one embodiment, the grooves are filled with a conductive material that provides electrical continuity between an electrode 106 and a transducer portion 22, as shown in FIG. 15. That is, filler material 108 provides an electrical path from a planar electrode 106 to the transducer portion 22. A suitable candidate for the filler material is an electrically conductive polymer.

Alternatively, the filler material 108 may be a polymer having a high dielectric constant. In this embodiment, the electrical coupling between the electrode 106 and the transducer portion 22 is a capacitive coupling. The drive signal connected to the electrodes 36 and 106 must be greater than a drive signal for operating a transducer device in which the filler material is electrically conductive. This approach also can be used in conjunction with an electrode which has been deposited. The high dielectric polymer would bridge possible gaps in the electrode, maintaining regions of equipotential at the surface of the ceramic.

Whether the filler material is deposited before or after the electrodes, depositing filler material within the microgrooves 30 of FIG. 12 can be accomplished using a number of techniques. A quantity of filler material may be placed at the surface of the impedance matching portion 24 and then forced into the microgrooves using a high pressure gas. Chambers for applying the high pressure gas are known in the art. Alternatively, the filler material may be forced within the microgrooves 30 by use of vacuum force, again using a chamber device. A third technique is to apply a low viscosity polymer in an uncured form at room temperature and either to exert a pressure to fill the microgrooves or to allow the soft filler material to fill the grooves using the inherent surface tension. A doctor blade may be used in practicing this technique. The polymer is then cured and the electrode is applied. Excess polymer at the surface can be removed using a grinding wheel, and a front electrode can be deposited. Alternatively, the polymer can be slightly under-filled. If the polymer does not cover the top of the grooves, no grinding is necessary before the electrode is deposited.

In another embodiment, the filler material is applied using a centrifuge process. A slurry of distinct materials may be used, with the components separating according to molecular weight as centrifugal force is applied. If the different components of the slurry have the same particle size within the powder form, but have different densities and correspondingly different acoustic impedances, the acoustic impedance of the impedance matching layer will vary with the distance from the transducer portion 22 of the device. That is, a graded impedance matching layer is formed. For example, the acoustic impedance of a bulk piezoelectric ceramic (PZT) of a transducer used in the medical field may be 33 MRayl, while the acoustic impedance of human tissue is approximately 1.5 MRayl. Ideally, a gradual change of acoustic impedance is created from the bulk ceramic to the tissue. Such a gradual change would provide an efficient transfer of energy to and from the tissue regions of interest. The efficient transfer of energy, typically over a wide range of frequencies, also reduces reverberations within the transducer. The imaging resolution of the transducer is therefore enhanced.

The gradual change of acoustic impedance from 33 MRayl to 1.5 MRayl may be divided into eight sections, each having its own acoustic impedance. In such an embodiment, eight acoustically distinct materials may be present in the slurry of the filler material. The volume fraction of each of the eight materials can be adjusted in order to ensure that the eight sections will have a generally equal thickness when the filler material has been subjected to the centrifuge process. The particle size for each material can be equal. However, the densities of the materials vary, such that the materials separate during the centrifuge process. The particle size and the volume fraction of the materials determine the thickness of each section. While not critical, the size of the particles is typically within the range of 5 μm to 20 μm. By example, the filler slurry may have the following eight materials within a soft polymer having an acoustic impedance of approximately 2.5 MRayl:

| MATERIAL | ACOUSTIC IMPEDANCE | DENSITY ($Kg/m^3$) |
|---|---|---|
| 1) Silver particles | 38.00 MRayl | $10.60 \times 10^3$ |
| 2) PZT particles | 33.00 MRayl | $7.43 \times 10^3$ |
| 3) Zirconium particles | 29.00 MRayl | $6.48 \times 10^3$ |
| 4) Lead metaniobate particles | 20.50 MRayl | $6.20 \times 10^3$ |
| 5) Granite particles | 17.60 MRayl | $2.70 \times 10^3$ |
| 6) Carbon particles | 7.30 MRayl | $2.21 \times 10^3$ |
| 7) Cured Stycast epoxy particles | 2.60 MRayl | $1.19 \times 10^3$ |
| 8) Polyethylene, low density | 1.79 MRayl | $0.92 \times 10^3$ |

The acoustic impedance of each material, in the absence of the soft polymer, is shown. Alternatively, a single material may be used to form the filler material, but the single material should vary in particle size, e.g. lead metaniobate particles. The centrifuge process will then cause the smaller particles to settle at the top, while larger and denser, and consequently higher acoustic impedance, particles would migrate to the bottom. For the centrifuge process, the average rate of sedimentation is given by:

$$\frac{4}{3}\pi\alpha^3(\rho-\rho')\omega^2 r = 6\pi\eta\alpha\gamma$$

or $$\frac{2}{9}\alpha^2(\rho-\rho')\frac{\omega^2 r}{\eta} = \gamma$$

where $\alpha$ is the radius of particles (assuming spherical particles), $\rho$ is the particle density, $\rho'$ is the fluid density, $\omega$ is the angular velocity, r is the radial distance of particles from the axis of rotation, $\eta$ is the coefficient of viscosity, and $\gamma$ is the average rate of sedimentation of spherical particles. For more information see *The Encyclopedia of Physics,* 3rd edition by Robert M. Besancon, published by Van Nostrand Reinhold Company. As is understood by persons skilled in the art, when the centrifuge process is used the number of sections and the selection of materials can be varied. In fact, the exponential variation in the impedance of the graded impedance matching layer provides an improved acoustic impedance match. The exponential variation is described as follows:

$$Z(x)=Z_c \times \exp(-a \times x)$$

where $Z_c$ is the acoustic impedance of the bulk ceramic, Z(x) is the acoustic impedance as a function of spatial location along the thickness of the matching layer with departure from the bulk ceramic, a is a constant determining the gradient of the slope, and×is the spatial location. Preferably, the constant a is between 0.1 and 1.0. The thickness of the graded impedance matching layer is such that it is typically at least $\lambda/2$ in thickness and it terminates at approximately the impedance of the medium of interest, e.g. 1.5 MRayl if acoustic waves are to pass through human tissue.

Returning to FIG. 14, the device is then poled. This process may include placing the piezoelectric structure into a suitable oven and elevating the temperature to the Curie point of the raw piezoceramic material. A source of a strong direct current is connected to the electrodes 34 and 36. For example, an electric field of approximately 20 kilovolts/centimeter may be applied across the piezoceramic device. The temperature is then decreased. Because an electric potential difference across the thickness of the piezoelectric layer 32 of the impedance matching portion 24 is only a small fraction of a total electrical potential between the electrodes 34 and 36, as discussed with reference to FIG. 3, the piezoelectric layer 32 substantially retains the random alignment of individual ferroelectric domains present in the raw piezoceramic material. Accordingly, the inert piezoelectric layer 32 is only weakly poled and remains electromechanically inert. In contrast, the poling process aligns a great majority of individual ferroelectric domains in the transducer portion 22, so that the transducer portion is strongly poled and is electromechanically active. Alternatively, poling may take place in a vacuum environment using thermal processing or may be achieved by corona oil bath poling techniques.

Figure 16:
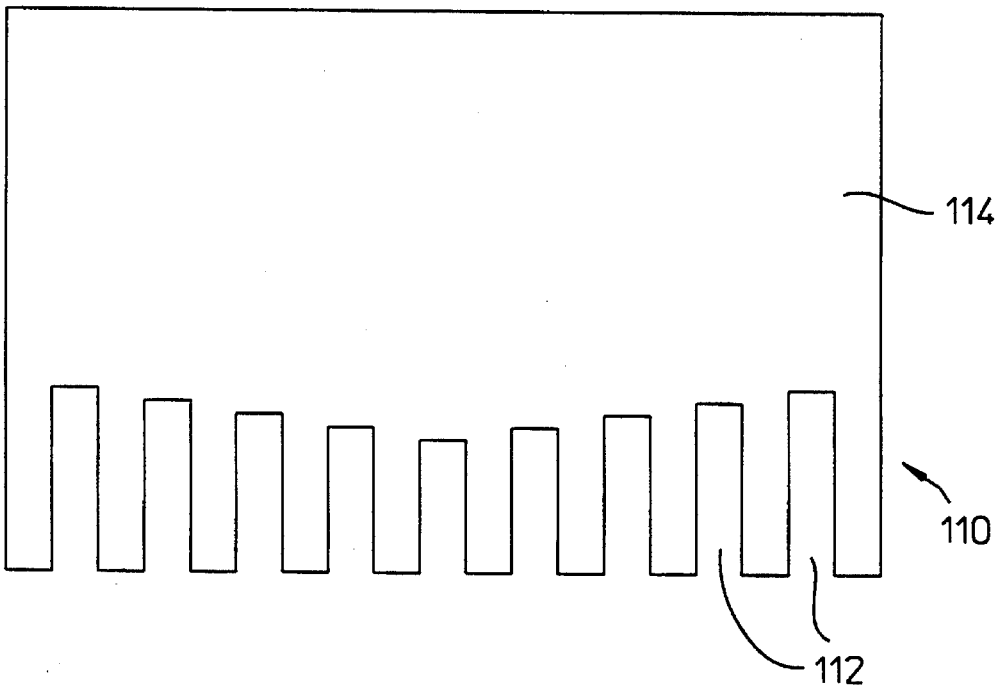
FIGS. 16–20 are views of alternative embodiments for forming grooves in an integral impedance matching portion in accordance with the invention.

Another form of designing a wideband transducer using microgrooves is shown in FIG. 16. Grooves 112 of an impedance matching portion 110 vary with respect to depth. The bulk region 114 of the transducer therefore has a different thickness at different sections. Since thickness is a factor in determining the resonant frequency of a transducer, the different sections of transducer of FIG. 16 will vary with respect to seeking a resonant frequency. Moreover, the impedance matching portion 110 varies in thickness. A resulting frequency offset increases the bandwidth of the transducer.

Figure 17:
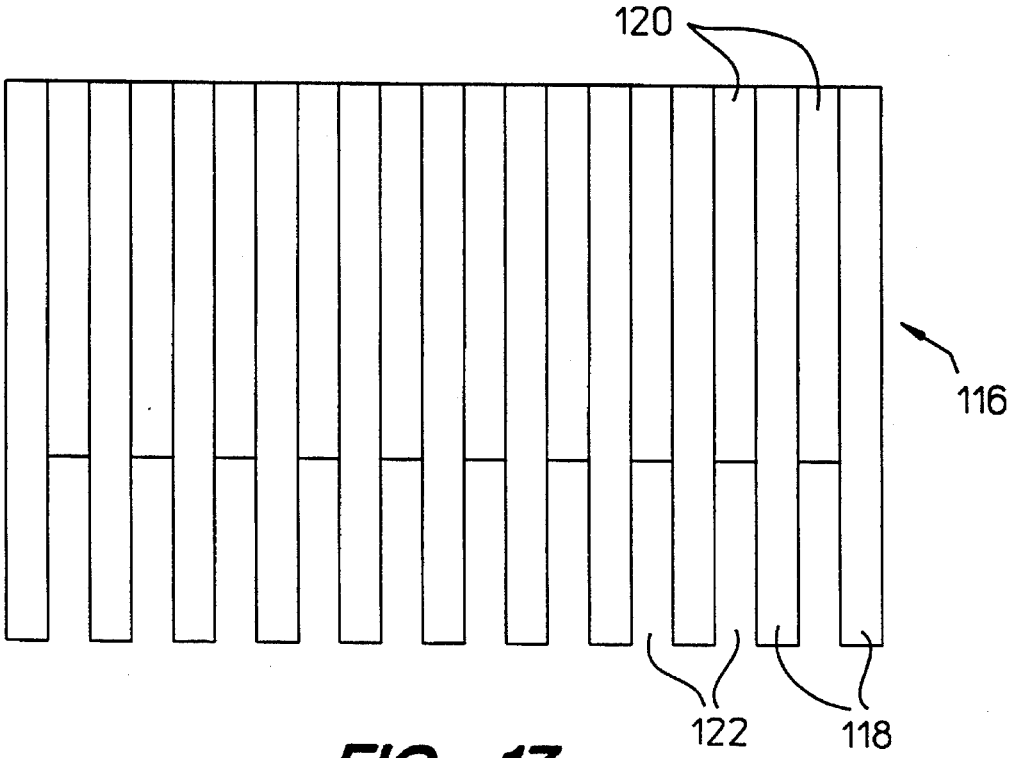

FIG. 17 illustrates another embodiment of fabricating a transducer device having integral transducer and impedance matching portions. The transducer portion 116 is formed by connecting a series of thin piezoelectric ceramic members. First piezoelectric members 118 extend beyond second piezoelectric members 120 to form grooves 122 having depths, widths and a pitch in accordance with the principles described above with reference to other methods of forming integral impedance matching layers. Sequential extrusions or screen printings may be used to form the transducer device, or techniques similar to those employed to fabricate multilayer capacitors may be utilized. Filler material and electrodes are added as previously described.

Figure 18:
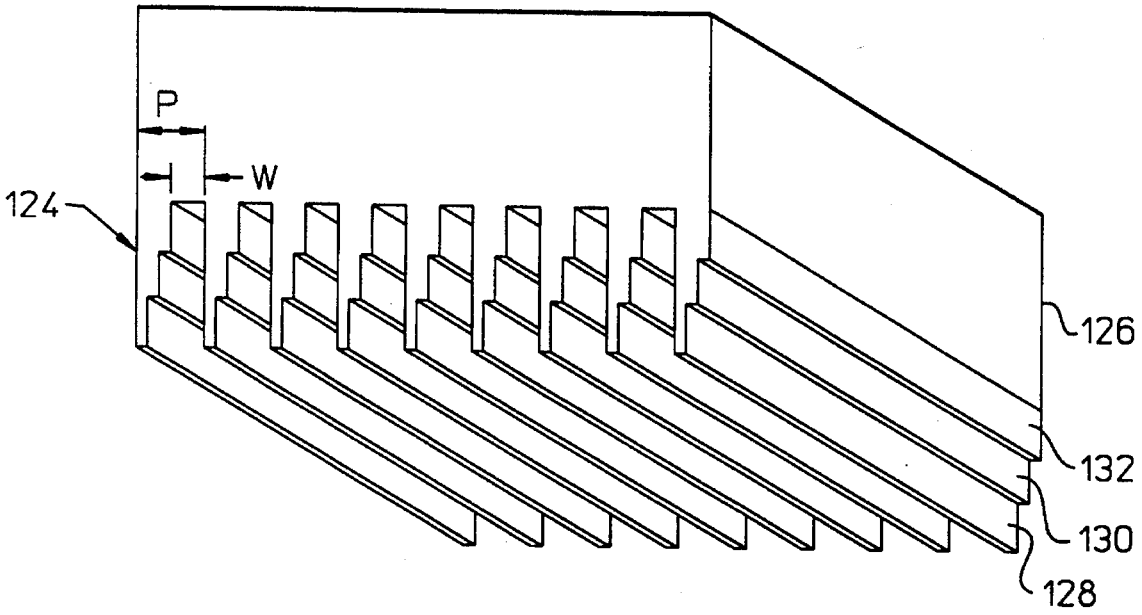

FIG. 18 illustrates an embodiment in which piezoelectric material having an inert piezoelectric layer 124 integral with a transducer layer 126. A "stair step" pattern of grooves is formed to include a first set 128, a second set 130, and a third set 132. These sets vary with respect to both depth and width. Each of the depths is approximately equal to an integral multiple of one-quarter of a wavelength of acoustic energy to be generated by the transducer portion 126. A single filler material may be deposited in each of the sets of grooves 128–132. Alternatively, different filler materials may be deposited in each of the sets of grooves to achieve a desired frequency response. Dicing, sputtering, and poling processes may be used to form the structure of FIG. 18.

Figure 19:
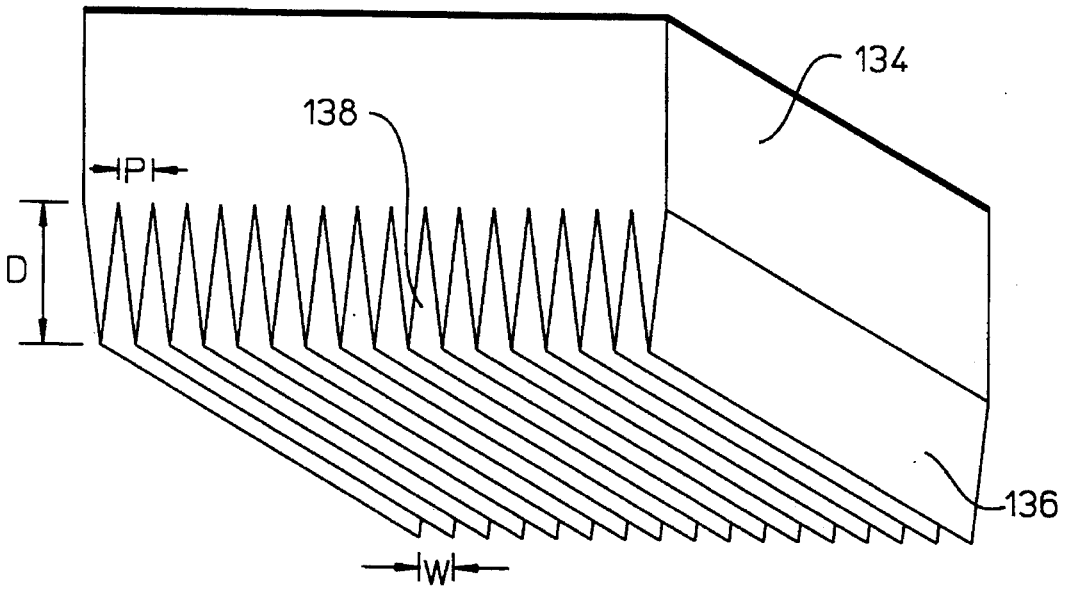

In place of the abrupt "stair step" pattern to provide a structure with enhanced acoustic performance, such as broad frequency response or improved acoustic sensitivity, grooves may be formed to have a smooth "V" profile as shown in FIG. 19. This embodiment may be formed in a manner similar to the techniques described above. A slab 134 of piezoelectric material having an integral inert piezoelectric layer 136 includes grooves 38 having an inverted "V" profile. The grooves may be formed (using any of the techniques previously described) to have a pitch, P, a width, W, and a depth, D, according to the principles set forth above. As another alternative, the profile of ceramic columns may be exponential, resulting in an exponentially varying acoustic impedance. Alternatively, pyramid-shaped columns can be formed making a gradual impedance matching layer.

Figure 20:
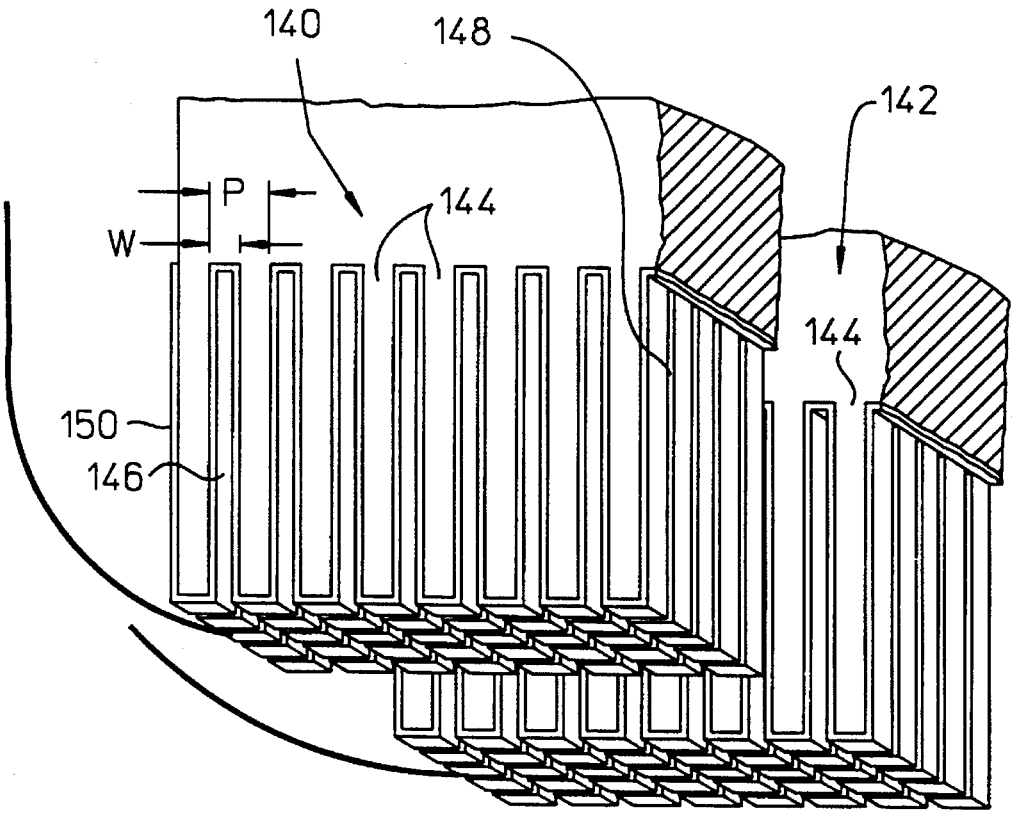

In FIG. 20, two piezoelectric elements 140 and 142 of a transducer device are shown as each having a two-dimensional array of downwardly depending posts 144 that define the integral piezoelectric layer. Rather than merely having grooves 146 that extend parallel to an azimuthal dimension, the elements 140 and 142 also include grooves 148 extending parallel to the elevation dimension of the elements. The two sets of grooves may be formed using dicing techniques, or any of the other techniques described above. A metal film 150 is sputtered onto the rear face of each element to provide a rear electrode that extends into and contacts the grooves 146 and 148. Alternatively, the grooves may contain a filler material, so as to allow use of a planar rear electrode.

We claim:

1. A method of fabricating a transducer device comprising:

providing a piezoelectric member having a thickness from a first face to a second face, said first and second faces being on opposed sides of said piezoelectric member;

selecting at least a region of said piezoelectric member to form a first piezoelectric element;

dividing said thickness of said selected region into a transducer portion for converting between electrical and acoustic wave energy and an acoustic impedance matching portion, including forming grooves into said acoustic impedance matching portion such that said grooves extend through said first face, thereby forming said acoustic impedance matching portion to include a plurality of spaced apart segments extending integrally from said transducer portion; and forming electrodes in electrical communication with opposed sides of said piezoelectric member for selectively applying an electrical potential across said transducer portion.

2. The method of claim 1 further comprising poling said transducer portion to align ferroelectric domains, said poling occurring subsequent to said forming said grooves.

3. The method of claim 1 wherein forming said grooves is a step including removing material from said acoustic impedance matching portion using one of dicing or laser cutting techniques.

4. The method of claim 1 wherein providing said piezoelectric member includes selecting a piezoelectric ceramic material and includes using molding techniques to form said piezoelectric acoustic material into a desired shape.

5. The method of claim 1 further comprising forming filler material in said grooves, including selecting a filler material based upon an acoustic impedance of said filler material.

6. The method of claim 5 wherein forming said filler material in said grooves includes applying centrifugal force to said piezoelectric member and said filler material such that said filler material centrifugally separates into components to form an acoustic impedance gradient with departure from said transducer portion, including selecting said filler material to include components having substantially different properties with respect to at least one of acoustic impedance density and particle size.

7. The method of claim 5 wherein forming said filler material in said grooves includes applying a positive pressure to said filler material.

8. The method of claim 5 wherein forming said filler material includes applying vacuum pressure to said filler material.

9. The method of claim 5 wherein selecting said filler material is a step of selecting an electrically conductive material.

10. The method of claim 5 wherein selecting said filler material is a step of selecting a material having a high dielectric constant.

11. The method of claim 1 wherein forming said grooves includes varying depths of grooves in a series of parallel grooves, variations in depth being selected to form said transducer portion to have a plurality of different resonant frequencies and to form said acoustic impedance matching portion to have a plurality of different thicknesses.

12. The method of claim 1 wherein forming said grooves includes varying the pitch off said grooves, variations in pitch being selected to provide apodization along an elevation aperture of said transducer portion.

13. The method of claim 1 wherein forming said grooves includes using photolithographic techniques.

14. The method of claim 1 wherein forming said grooves includes masking first areas of said first face and removing second areas between said masked first areas.

15. A method of fabricating a transducer device comprising:

selecting a piezoelectric material;

assembling said piezoelectric material into a configuration in which an acoustic impedance matching portion extends in unitary fashion from a transducer portion, including forming said acoustic impedance matching portion to include spaced apart segments integral with said transducer portion; and poling said transducer portion of said configuration of said piezoelectric material, while leaving ferromagnetic domains of said acoustic impedance matching portion generally unaligned.

16. The method of claim 15 wherein assembling said piezoelectric material includes molding said piezoelectric material into said configuration.

17. The method of claim 15 further comprising forming electrodes on opposed sides of said configuration such that a potential difference is applied across said transducer portion upon applying a signal to said electrodes.

18. The method of claim 15 wherein assembling said piezoelectric material includes stacking piezoelectric members in contacting relationship and further includes arranging said piezoelectric members to vary in dimension such that said acoustic impedance matching portion is formed by regions of said first piezoelectric members that extend beyond edges of said second piezoelectric members.

19. The method of claim 15 further comprising forming filler material within grooves between adjacent segments of said acoustic impedance matching portion.

20. The method of claim 19 Wherein forming filler material includes centrifugally depositing said filler material within said grooves.

21. The method of claim 15 wherein adjacent segments of said acoustic matching portion are separated by a groove, said segments varying in pitch such that apodization along an elevation aperture of said transducer portion is provided.

* * * * *